US007043855B2

(12) United States Patent
Heilman et al.

(10) Patent No.: US 7,043,855 B2
(45) Date of Patent: May 16, 2006

(54) FABRIC ARTICLE TREATING DEVICE COMPRISING MORE THAN ONE HOUSING

(75) Inventors: Laura Lynn Heilman, Cincinnati, OH (US); Christopher Lawrence Smith, Liberty Township, OH (US); Keith David Fanta, Middletown, OH (US); Paul Amaat Raymond Gerard France, West Chester, OH (US); Dean Larry Du Val, Lebanon, OH (US); Michael Joseph Orr, West Chester, OH (US); Jichun Shi, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/697,685

(22) Filed: Oct. 29, 2003

(65) Prior Publication Data

US 2004/0134090 A1 Jul. 15, 2004

Related U.S. Application Data

(63) Continuation-in-part of application No. 10/418,595, filed on Apr. 17, 2003.

(60) Provisional application No. 60/426,439, filed on Nov. 14, 2002, provisional application No. 60/374,601, filed on Apr. 22, 2002.

(51) Int. Cl.
*F26B 7/00* (2006.01)

(52) U.S. Cl. ..... 34/389; 34/595

(58) Field of Classification Search ..... 34/389, 34/390, 597, 595, 343, 348

See application file for complete search history.

(56) References Cited

U.S. PATENT DOCUMENTS

| | | | |
|---|---|---|---|
| 2,079,280 | A | 5/1937 | Couch |
| 2,807,893 | A | 10/1957 | Morey |
| 2,812,593 | A | 11/1957 | Olthuis |
| 2,846,776 | A | 8/1958 | Clark |
| 2,851,791 | A | 9/1958 | Olthuis |
| 2,873,539 | A | 2/1959 | Morey |
| 2,941,309 | A | 6/1960 | Cobb |
| 2,958,954 | A | 11/1960 | Longenecker |

(Continued)

FOREIGN PATENT DOCUMENTS

DE 23 18 596 B2 4/1980

(Continued)

OTHER PUBLICATIONS

International Critical Tables of Numerical Data, Physics, Chemistry and Technology, National Research Council of the United States of America, Edward W. Washburn, editior in chief, first electronic edition, published by Knovel, Norwich, New York, 2003, pp. 148-162.

(Continued)

*Primary Examiner*—S. Gravini
(74) *Attorney, Agent, or Firm*—Julia A. Glazer; Kim William Zerby; Steven W. Miller

(57) ABSTRACT

A treating device for use with a fabric article drying appliance. The treating device dispenses a benefit composition into a chamber so as to provide benefits to fabric articles contained within the fabric article drying appliance. The treating device is comprised of at least two housings in communication with one another wherein at least one housing is located in the interior of a fabric article drying appliance and at least one housing is located outside of the fabric article drying appliance.

21 Claims, 15 Drawing Sheets

U.S. PATENT DOCUMENTS 3,002,288 A 10/1961 Conlee
3,022,580 A 2/1962 Doty
3,103,450 A 9/1963 Janson
3,114,653 A 12/1963 Kruzan
3,172,604 A 3/1965 Brock
3,180,037 A 4/1965 Etal
3,239,947 A 3/1966 Etal
3,267,701 A 8/1966 Mandarino
3,364,585 A 1/1968 Etal
3,583,180 A 6/1971 Arbogast
3,595,036 A 7/1971 Laddle
3,634,947 A 1/1972 Furgal
3,816,070 A 6/1974 Candor et al.
3,872,604 A 3/1975 Keller
4,009,598 A 3/1977 Bernard et al.
4,014,105 A 3/1977 Furgal et al.
4,022,938 A 5/1977 Zaki et al.
4,098,937 A 7/1978 Mizuno et al.
4,207,683 A 6/1980 Horton
4,214,038 A * 7/1980 McCarty et al. ..... 427/242
4,236,320 A 12/1980 Schwadike et al.
4,242,377 A 12/1980 Roberts et al.
4,341,347 A 7/1982 DeVittorio
4,501,682 A 2/1985 Goodman et al.
4,511,495 A 4/1985 Melville
4,532,722 A 8/1985 Sax
4,567,675 A 2/1986 Rennie
4,579,279 A 4/1986 Marchant
4,618,099 A 10/1986 Nagao et al.
4,642,908 A 2/1987 Brenner
4,806,254 A 2/1989 Church
4,808,086 A * 2/1989 Evans et al. ..... 510/517
4,891,890 A 1/1990 Church
5,040,311 A 8/1991 Roy
5,234,610 A 8/1993 Gardlik et al.
5,438,773 A 8/1995 Chaffee
5,442,938 A 8/1995 Kislyuk
5,445,747 A 8/1995 Kvietok et al.
5,461,742 A 10/1995 Pasad et al.
5,595,071 A 1/1997 Pasad et al.
5,675,911 A * 10/1997 Moser ..... 34/389
5,749,163 A 5/1998 Staub et al.
5,771,604 A 6/1998 Wunderlich et al.
5,789,368 A 8/1998 You et al.
5,810,265 A 9/1998 Cornelius et al.
5,884,418 A 3/1999 Mc Nally
5,912,408 A 6/1999 Trinh et al.
5,930,909 A 8/1999 Mc Nally
5,945,111 A 8/1999 Esser
5,965,517 A 10/1999 Mooney
5,966,831 A 10/1999 Anderson
5,968,404 A 10/1999 Trinh et al.
5,980,583 A 11/1999 Staub et al.
5,997,759 A 12/1999 Trinh et al.
6,001,343 A 12/1999 Trinh et al.
6,067,723 A 5/2000 Lafrenz
6,103,678 A 8/2000 Masschelein et al.
6,160,110 A 12/2000 Thomaides et al.
6,277,810 B1 8/2001 Baines et al.
6,279,834 B1 8/2001 Fox et al.
6,315,800 B1 11/2001 Gomes et al.
6,376,455 B1 4/2002 Friedli et al.
6,474,563 B1 11/2002 Pletcher et al.
6,491,840 B1 12/2002 Frankenbach et al.
6,503,413 B1 1/2003 Uchiyama et al.
6,571,993 B1 6/2003 Rodd et al.
6,574,883 B1 6/2003 Giblin et al.
6,604,297 B1 8/2003 Hagemann et al.
6,609,311 B1 8/2003 Hagemann et al.
6,696,405 B1 2/2004 Mooney
6,883,723 B1 4/2005 Griese et al.
6,889,399 B1 5/2005 Steiner et al.
2001/0036909 A1 11/2001 Levinson
2001/0044399 A1 11/2001 Keppie et al.
2001/0052551 A1 12/2001 Pletcher et al.
2001/0052552 A1 12/2001 Hamaguchi et al.
2002/0050073 A1 5/2002 Hagemann et al.
2002/0069465 A1 6/2002 Chute et al.
2002/0078589 A1 6/2002 Hagemann et al.
2002/0083615 A1 7/2002 Giblin et al.
2002/0100122 A1 8/2002 Rodrigues et al.
2002/0112293 A1 8/2002 Trinh et al.
2003/0035748 A1 2/2003 Trinh et al.
2003/0196348 A1 10/2003 Hagemann et al.
2003/0199416 A1 10/2003 Fry et al.
2003/0199417 A1 10/2003 Fry et al.
2003/0200674 A1 10/2003 Fry et al.
2003/0213145 A1 11/2003 Hagemann et al.
2003/0224965 A1 12/2003 Conley et al.
2004/0064970 A1 4/2004 Hagemann et al.
2004/0118014 A1 6/2004 Burgess et al.
2004/0134094 A1 7/2004 Hahn et al.
2004/0221476 A1 11/2004 Jones et al.
2004/0253376 A1 12/2004 Parker
2005/0020478 A1 1/2005 Cooke et al.

FOREIGN PATENT DOCUMENTS

EP 0 130 682 1/1985
EP 0 118 313 5/1987
EP 0 315 879 B1 5/1989
EP 0 204 484 B1 3/1992
EP 0 594 154 A1 4/1994
EP 0 848 999 A2 6/1998
EP 0 676 497 B1 9/1999
EP 1 479 757 A1 11/2004
GB 2 066 309 A 7/1981
GB 2 231 944 A 11/1990
GB 2 354 006 B 3/2001
GB 2 366 568 A 3/2002
GB 2 346 678 B 10/2002
JP 02-302300 12/1990
JP 1995068094 A2 3/1995
JP 08-150293 6/1996
JP 1996215488 A 8/1996
JP 2002069832 A2 3/2002
JP 2002115182 A 4/2002
WO WO 96/09430 3/1996
WO WO 99/55952 A1 11/1999
WO WO 99/55953 A1 11/1999
WO WO 00/01421 A1 1/2000
WO WO 00/01422 A1 1/2000
WO WO 00/01493 A1 1/2000
WO WO 00/11133 3/2000
WO WO 00/24851 A2 5/2000
WO WO 00/24856 A1 5/2000
WO WO 00/24858 A1 5/2000
WO WO 00/38512 A1 7/2000
WO WO 00/55292 9/2000
WO WO 00/58428 10/2000
WO WO 01/07710 A1 2/2001
WO WO 01/18145 A2 3/2001
WO WO 01/66264 A1 9/2001
WO WO 02/08510 A1 1/2002
WO WO 02/12423 A2 2/2002
WO WO 02/33161 A1 4/2002
WO WO 02/40623 A2 5/2002
WO WO 03/004170 A1 1/2003
WO WO 03/008528 A1 1/2003
WO WO 03/087286 A1 10/2003
WO WO 03/087461 A1 10/2003
WO WO 03/102289 A1 12/2003
WO WO 2004/099489 A2 11/2004

OTHER PUBLICATIONS

Handbook of Chemistry and Physics, 3rd electronic edition, following the 81st printed edition, David R. Lide, editor-in-chief, published by CRC Press, Inc. 2000, Boca Raton, Florida, pp. 5-102 to 5-103, 5-4 to 5-88.

Perry's Chemical Engineer's Handbook, seventh edition, following the 81st printed edition, published by McGraw-Hill, ISBN 0-07-049841-5, 1997, pp. 2-187 to 2-195.

Brokaw, Leslie—"Get a Whiff Of This", Inc.com Magazine, Nov. 1988, (1 page) Copyright 2003 Gruner + Jahr USA Publishing, Inc.com, 77 North Washington Street, Boston, MA 02114.

StainsFile—"Classification of Dyes"; "Basic Dyes"; "Direct Dyes"; "Acid Dyes"; Comparison of Dye Structure; "Structure and Colour in Dyes"; (16 pages). Internet Website http://members.pgonline.com/~bryand/StainsFile/dyes/class/dyeclass.htm, Nov. 2002.

Medlin, Jennifer—"Microban, Germ Warfare", Environmental Health Perpectives v.105, n.3, Mar97 (5 pages). Internet Website www.mindfully.org/Plastic/Microban-Germ-Warfare.htm.

Exair-Mail Newsletter—Winter Mar. 2002 (2 pages). Exair Corporation, 1250 Century Circle North, Cincinnati, Ohio, 45246-3309.

Fyffe, Matt—Technical Report—"Recent Developments in Long-Range Static Elimination", Jun. 2003 (3 pages). Meech Static Eliminators, USA, Richfield, Ohio, Internet Website www.meech.com.

Quantum Research Group "Capacitance Explained" printed Nov. 18, 2004 (3 pages). Internet Website www.qprox.com/background/capacitance.php.

* cited by examiner

FABRIC ARTICLE TREATING DEVICE COMPRISING MORE THAN ONE HOUSING

CROSS REFERENCE TO RELATED APPLICATIONS

This application is a continuation-in-part of U.S. application Ser. No. 10/418,595, filed Apr. 17, 2003; which claims the benefit of U.S. Provisional Application Serial No. 60/374,601, filed Apr. 22, 2002; and U.S. Provisional Application Serial No. 60/426,438, filed Nov. 14, 2002.

FIELD OF THE INVENTION

The present invention relates to a treating device for use with a fabric article drying appliance (a non-limiting example of which includes a clothes dryer). The treating device dispenses a benefit composition through a nozzle that directs the benefit composition into a chamber (a non-limiting example of which includes a drum of a clothes dryer) so as to provide benefits to fabric articles contained within the fabric article drying appliance. The treating device is comprised of at least two housings. At least one of the housings is located in the interior of a fabric article drying appliance while at least one other housing is located outside of the fabric article drying appliance. The interior housing and exterior housing of the treating device are in communication with one another.

The present invention also relates to a system and a method for treating fabrics.

BACKGROUND OF THE INVENTION

U.S. Pat. No. 4,891,890 purports to describe a device for dispensing treating agents into clothes dryers. The device which is self-powered by batteries, is attached to the inside door of a conventional horizontal tumble dryer. However, the drawback of such a device is the harsh conditions within the dryer that it is subjected to. These harsh conditions, such as high temperature and high humidity, place a lot of strain on the lifetime and efficiency of the device's batteries and/or electronic components and can cause increased cost and/or inconvenience to a user of such a device. Additionally, when the device is wholly located inside the dryer, there is no means for the device to communicate with the user. Hence, there is limited means for the user to ascertain and/or control the operating status of the device.

The present invention overcomes these drawbacks by providing a device comprised of at least two housings wherein the two housings are in communication with one another and wherein at least one of the housings is located in the interior of a fabric article drying appliance (a non-limiting example of which includes a clothes dryer) and at least one housing is located outside of the fabric article drying appliance. The housing located in the interior of the fabric article drying appliance may contain for example a dispensing apparatus while the housing located outside of the drying appliance may contain for example sensitive components, non-limiting examples of which may include batteries, electrical components, and/or other heat and/or humidity sensitive components. The housing located outside of the drying appliance may also provide a means for a device to communicate with the user so that the user can control the device or ascertain the operating status of the device.

SUMMARY OF THE INVENTION

A fabric article treating device comprising an interior housing, located inside of a fabric article drying appliance and an exterior housing located outside of the fabric article drying appliance are in communication with one another. The interior housing and exterior housing may be connected to one another. The exterior housing may include sensitive components. In one embodiment, the interior housing and exterior housing are connected to one another with a flat cable. The interior housing and exterior housing may be in electrical communication with one another. The exterior housing may also include a power source. The fabric article drying appliance may include a door. In one embodiment, the interior housing may be located between the interior and exterior surfaces of the door.

The present invention also relates to a system for treating fabrics. The system comprises a fabric article drying appliance and a fabric article treating device. The fabric article treating device comprises an interior housing located inside of the fabric article drying appliance and an exterior housing located outside of the fabric article drying appliance. The interior housing and exterior housing are in communication with one another.

The present invention further relates to a method for treating fabrics. The method comprises providing a fabric article treating device wherein the fabric article treating device is comprised of an interior housing located inside of a fabric article drying appliance and an exterior housing located outside of the fabric article drying appliance. The interior housing and exterior housing are in communication with one another. A reservoir, pump, and nozzle are also included in the fabric article treating device. A benefit composition is contained in the reservoir. The benefit composition moves from the reservoir through the pump to the nozzle. The benefit composition is sprayed through the nozzle into the fabric article drying appliance.

BRIEF DESCRIPTION OF THE DRAWINGS

FIG. 11 is a perspective view from the opposite angle of the fabric article treating device of.

DETAILED DESCRIPTION OF THE INVENTION

Figure 1:
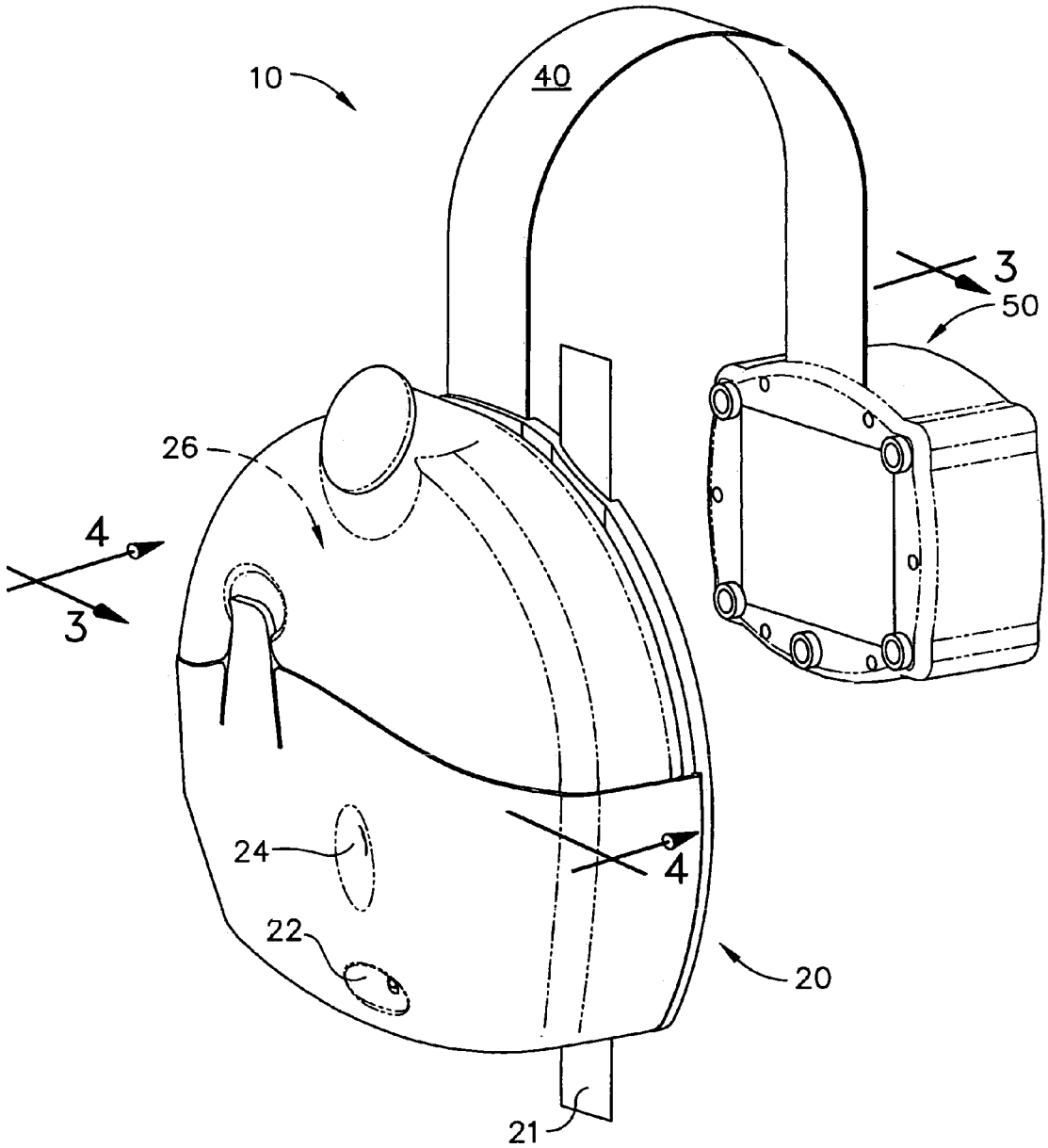
FIG. 1 is a perspective view of an embodiment of a fabric article treating device made in accordance with the present invention.

The phrase "fabric article treating system" as used herein means a fabric article drying appliance, a non-limiting example of which includes a conventional clothes dryers and/or modifications thereof. The fabric article treating system also includes a fabric article treating device which may be used to deliver a benefit composition.

"Fabric article" (or "fabric") as used herein means any article that is customarily cleaned in a conventional laundry process or in a dry cleaning process. The term encompasses articles of fabric including but not limited to: clothing, linen, draperies, clothing accessories, leather, floor coverings, sheets, towels, rags, canvas, polymer structures, and the like. The term also encompasses other items made in whole or in part of fabric material, such as tote bags, furniture covers, tarpaulins, shoes, and the like.

As used herein, the term "benefit composition" refers to a composition used to deliver a benefit to a fabric article. Non-limiting examples of materials and mixtures thereof which can comprise the benefit composition include: water, softening agents, crispening agents, perfume, water/stain repellents, refreshing agents, antistatic agents, antimicrobial agents, durable press agents, wrinkle resistant agents, odor resistance agents, abrasion resistance agents, solvents, and combinations thereof.

The present invention relates to a treating device for use with a fabric article drying appliance (a non-limiting example of which includes a clothes dryer). The treating device may be controlled substantially or totally independently of the fabric article drying appliance controls. The treating device dispenses a benefit composition through a nozzle that directs the benefit composition into a chamber (a non-limiting example of which includes a drum of a clothes dryer) so as to provide benefits to fabric articles contained within the fabric article drying appliance. The treating device is comprised of at least two housings. At least one of the housings is located in the interior of a fabric article drying appliance while at least one other housing is located outside of the fabric article drying appliance. The interior (or inner housing) and exterior (or outer housing) of the treating device are in communication with one another. Non-limiting examples of communication between the interior housing and exterior housing include electrical communication (wherein electrical signals are transferred between the interior and outer housing) and compositional transfer communication (i.e.; wherein a benefit composition is transferred between the outer and inner housing), and thermal communication (i.e.; wherein temperature differentials are transferred between the outer and inner housing a non-limiting example of which is wherein the benefit composition is heated in one housing and transferred to the other housing). The inner housing and outer housing may be connected to one another. Non-limiting means of connecting the inner and outer housing include a flat cable, a wire, and/or a conduit (a non-limiting example of which is a conduit for transferring benefit composition between the outer and inner housing).

Referring now to the embodiment of FIG. 1, a stand-alone controller and dispenser unit (i.e.; "treating device"), generally designated by the reference numeral 10, is illustrated as having two major enclosures (or housings) 20 and 50. The enclosure 20 acts as an inner housing which is located in the interior of a fabric article drying appliance, while the enclosure 50 acts as an outer or exterior housing that is located outside of the fabric article drying appliance. The enclosure 50 may be mounted on the exterior surface of the fabric article drying appliance door, yet may also be mounted on any exterior surface, non-limiting examples of which include: the side walls, the top walls, the outer surface of a top-opening lid, and the like, including a wall or other household structure that is separate from the fabric article drying appliance. Furthermore, the enclosure 20 may be mounted on any interior surface of the fabric article drying appliance, examples of which include, but are not limited to: the interior surface of the door, between the interior and exterior surfaces of the door (see FIG. 13), the drum of the fabric article drying appliance, the back wall; the inner surface of a top-opening lid, and the like.

The interior and exterior housings may be constructed of materials familiar to those of ordinary skill in the art. Non-limiting examples of such materials include polymeric materials including but not limited to polyurethane, polypropylene, polycarbonates, polyethylene, and combinations thereof and metals including but not limited to enameled metals.

Figure 8:
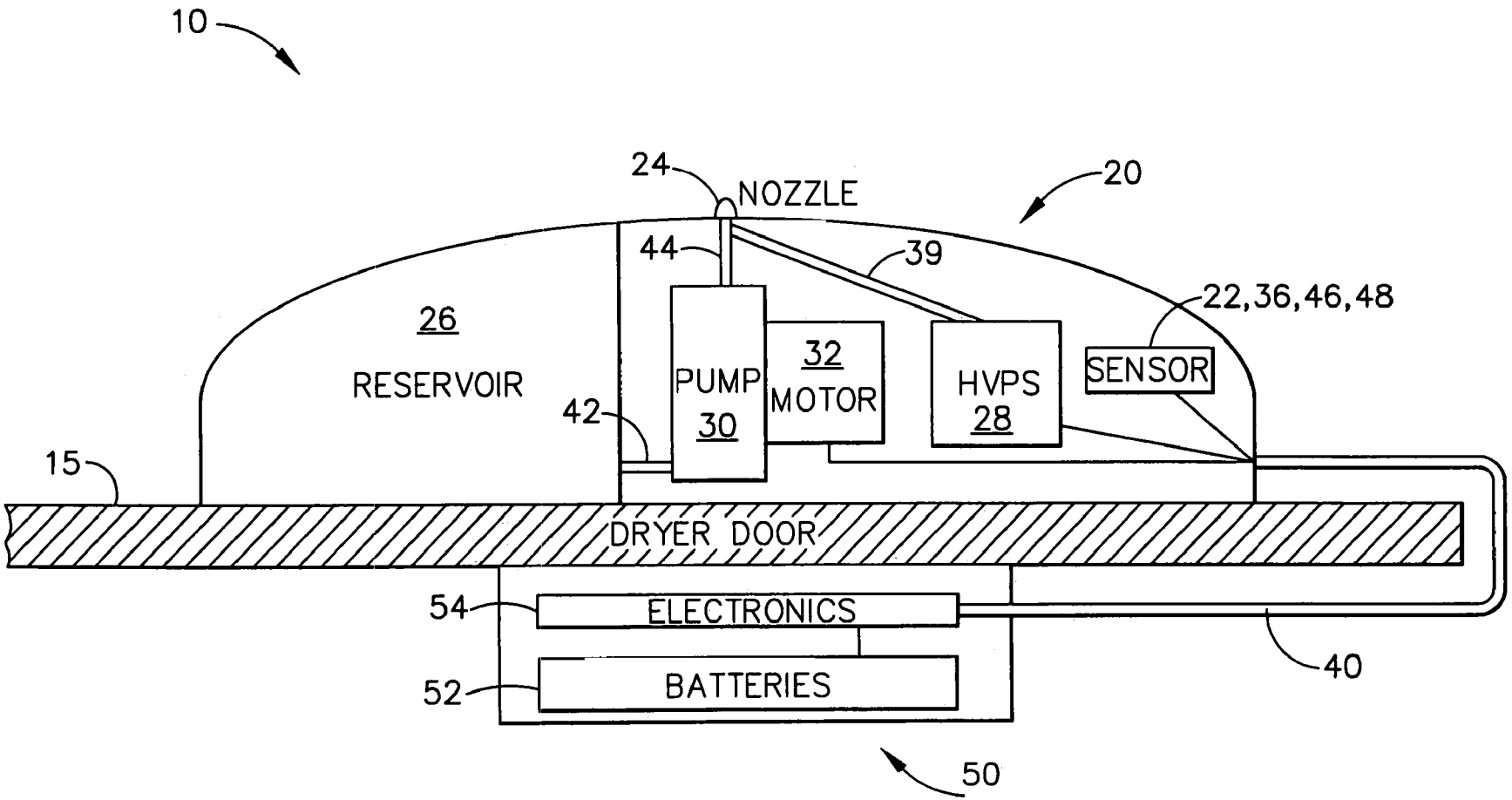
FIG. 8 is a diagrammatic view in partial cross-section of the fabric article treating device of FIG. 1, as it may be mounted to the door of a fabric article drying appliance.

Enclosure 50 may be permanently mounted to the exterior surface, or releasably attached to the exterior surface. Likewise, enclosure 20 may be permanently mounted to the interior surface, or releasably attached to the interior surface. One configuration for such an attachment is illustrated in FIG. 8, in which the door of the drying appliance is generally designated by the reference numeral 15. Other non-limiting attachments include magnets, suction cups, Velcro®, and the like. It will be understood that the term "door," as used herein, represents a movable closure structure that allows a person to access an interior volume of the drying appliance, and can be of virtually any physical form that will enable such access. The door "closure structure" could be a lid on the upper surface of the dryer appliance, or a hatch of some sort, or the like.

The treating device 10 may be grounded by way of being in contact with a grounded part of the fabric article drying appliance such as by a spring, patch, magnet, screw, arc corona discharge, or other attaching means, and/or by way of dissipating residual charge. One non-limiting way of dissipating the charge is by using an ionizing feature, for example a set of metallic wires extending away from the source. In many instances fabric article drying appliances such as clothes dryers have an enameled surface. One means of grounding would be to ground to the enameled surface of the fabric article drying appliance by utilizing a pin that penetrates the non-conductive enamel paint for grounding thereto. Another means of grounding to the non-conductive surface of a fabric article drying appliance comprises the usage of a thin metal plate that is positioned between the fabric article drying appliance and the fabric article treating device which serves to provide a capacitive discharge. Typical thickness of such a plate is from about 5 μm to about 5000 μm.

It will be understood that the present invention can be readily used in other types of fabric article "drying" devices, and is not limited solely to clothes "dryers." In the context of this patent document, the terms "dryer" or "drying apparatus" or "fabric article drying appliance" include devices that may or may not perform a true drying function, but may involve treating fabric without attempting to literally dry the fabric itself As noted above, the terms "dryer" or "drying apparatus" or "fabric article drying appliance" may include a "dry cleaning" process or apparatus, which may or may not literally involve a step of drying.

In addition to the above, it should be noted that some drying appliances include a drying chamber (or "drum") that does not literally move or rotate while the drying appliance is operating in a drying cycle. Some such drying appliances use moving air that passes through the drying chamber, and the chamber does not move while the drying cycle occurs. Such an example drying appliance has a door or other type of access cover that allows a person to insert the clothing to be dried into the chamber. In many cases, the person "hangs" the clothing on some type of upper rod within the drying chamber. Once that has been done, the door (or access cover) is closed, and the drying appliance can begin its drying function. A spraying cycle can take place within such a unit, however, care should be taken to ensure that the benefit composition becomes well dispersed within the drying chamber, so that certain fabric items do not receive a very large concentration of the benefit composition while other fabric items receive very little (or none) of the benefit composition.

The fabric article treating device 10 may comprise at least one nozzle 24 for the purpose of distributing the benefit composition into the fabric article drying appliance. Misting/atomizing of the benefit composition can be achieved using any suitable spraying device such as a hydraulic nozzle, sonic nebulizer, pressure swirl atomizers, high pressure fog nozzle or the like to deliver target particle sizes. Non-limiting examples of suitable nozzles include nozzles commercially available from Spray Systems, Inc. such as Spray Systems, Inc. of Ponoma, Calif. under the Model Nos.: 850, 1050, 1250, 1450 and 1650. Another suitable example of a nozzle is a pressure swirl atomizing nozzle made by Seaquist Dispensing of Cary, Ill. under the Model No. DU3813.

Optionally, filters and/or filtering techniques can be used to filter the benefit composition if desired. Non-limiting examples of this include: utilizing a filter in the treating device 10 prior to the nozzle 24; filtering the benefit composition prior to dispensing into the benefit composition reservoir; centrifuging the benefit composition prior to dispensing into the benefit composition reservoir; and the like; or combinations thereof.

Referring to FIG. 1, a discharge nozzle 24 and an optional "door sensor" 22 are visible on the inner housing 20, which also includes a benefit composition-holding reservoir 26 within an interior volume of the inner housing 20. The reservoir 26 may be used to hold a benefit composition. The benefit composition-holding reservoir 26 may be comprised of flexible, rigid, and/or semi-rigid material. Embodiments constructed out of rigid or semi-rigid materials may include a vent.

Figure 9:
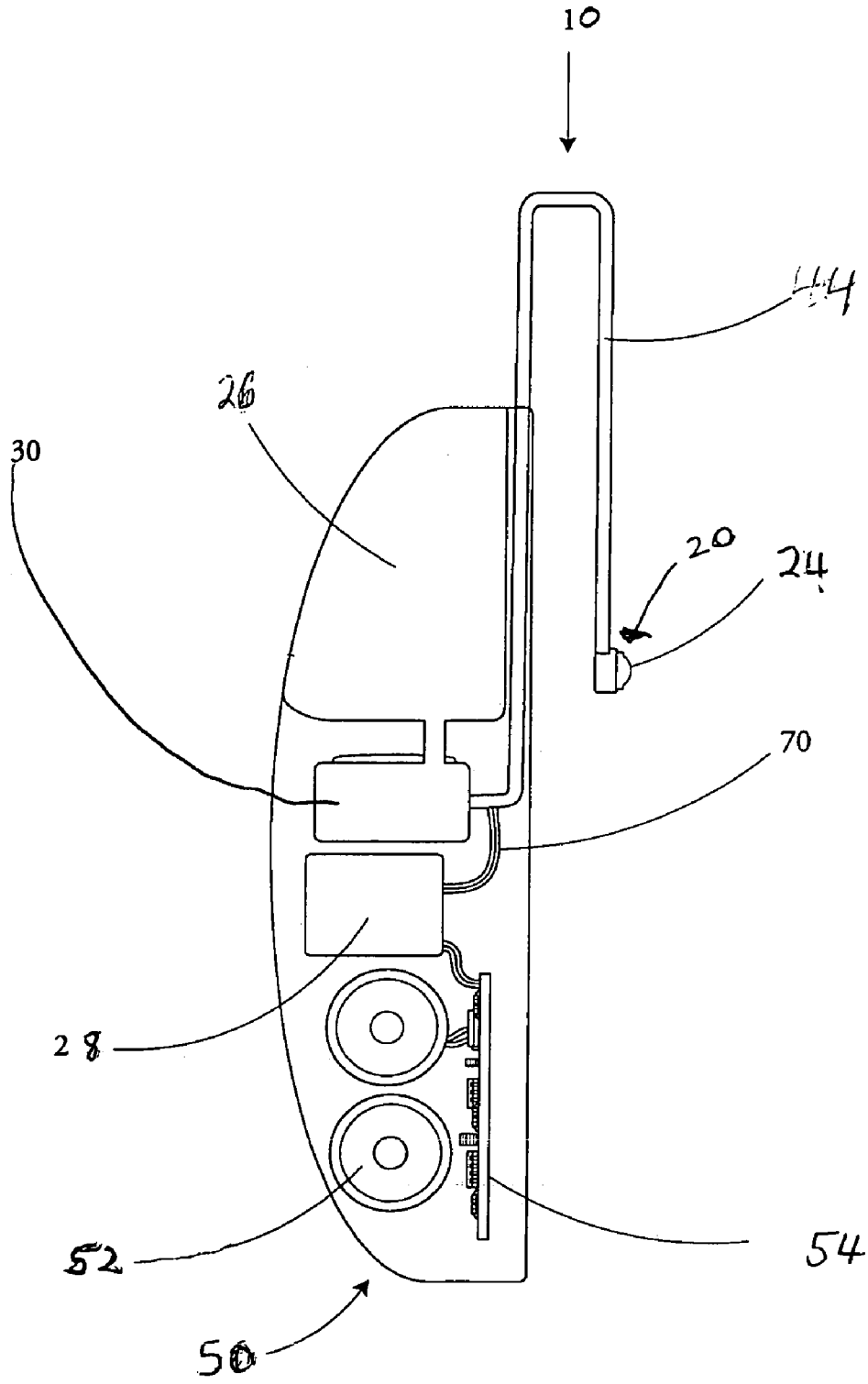
FIG. 9 is an elevational view from one end in partial cross-section of another embodiment of the fabric article treating device of the present invention taken along line 9—9 of FIG. 10.
Figure 10:
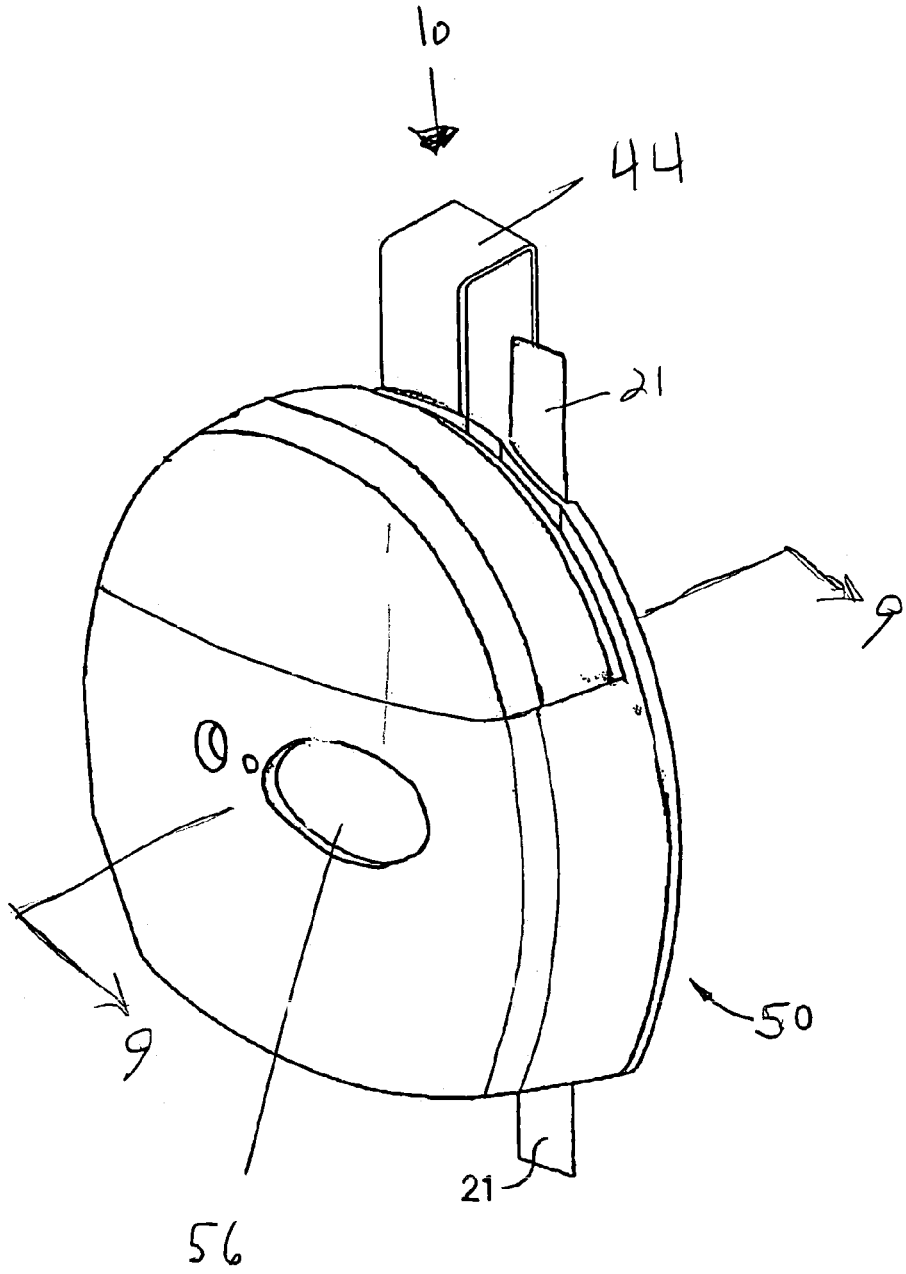
FIG. 10 is a perspective view of an embodiment of the fabric article treating device of the present invention.
Figure 11:
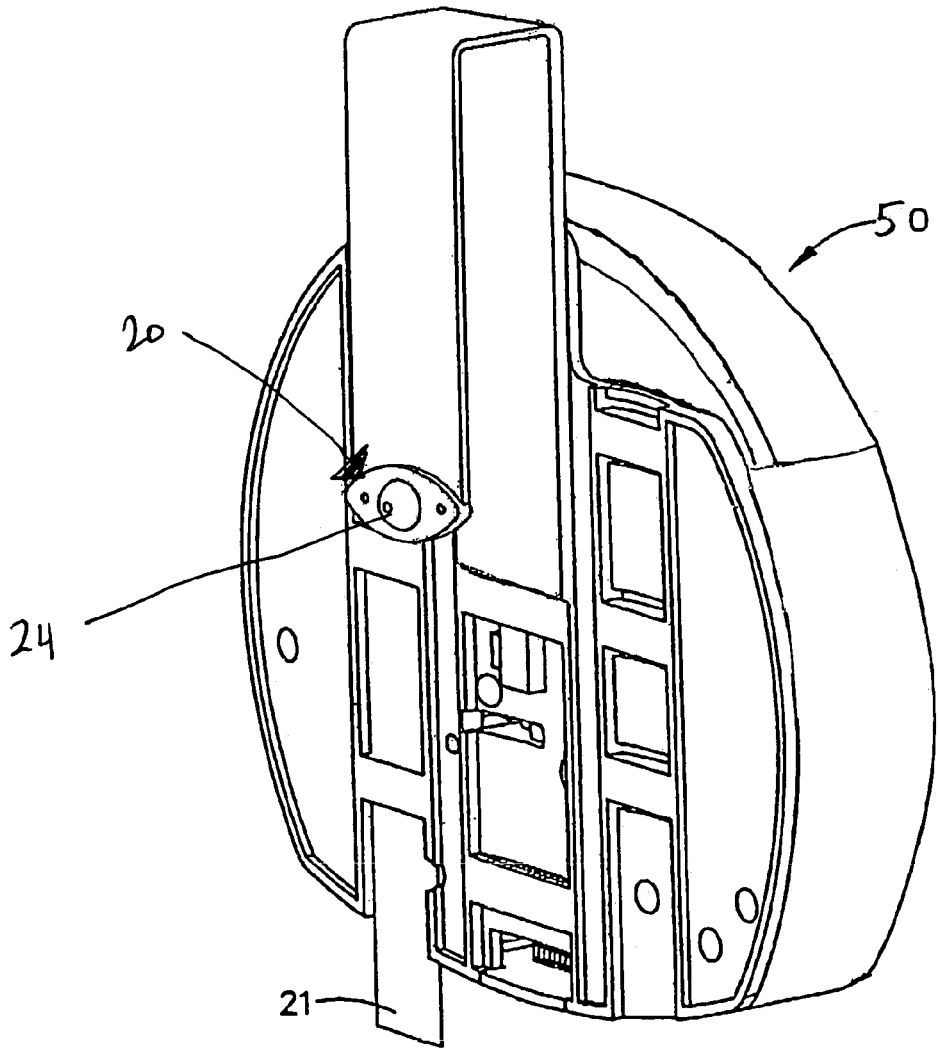

The discharge nozzle 24 can act as a fluid atomizing nozzle, using either a pressurized spray or, along with an optional high voltage power supply (not shown in FIG. 1) it can act as an electrostatic spray nozzle. The benefit composition can comprise a fluidic substance, such as a liquid or a gaseous compound, or it can comprise a solid compound in the form of particles, such as a powder. Reservoir 26 can take the form, for example, of a pouch or a cartridge; or perhaps could merely be a household water line for situations in which the benefit composition comprises potable water. Furthermore, the reservoir 26 may be integral with the inner housing 20, or it may be removably attached. Alternatively, as shown in FIGS. 9–11, the reservoir 26 may be integral with the outer housing 50, or it may be removably attached to the outer housing 50. Furthermore, the treating device 10 may include more than one reservoir 26. At least one reservoir 26 could be associated with the inner housing 20 and/or at least one reservoir could be associated with the outer housing 50.

The inner housing 20 and the outer housing 50 are in communication with one another. The inner housing 20 and outer housing 50 may be connected to one another. Non-limiting examples of connecting the inner housing 20 and the outer housing 50 may include utilizing a flat cable 40 (also sometimes referred to as a "ribbon cable") as shown in FIGS. 1–5 and 9–12, a wire, a wire or group of wires encased in a sheath of woven or non-woven material, a conduit (a non-limiting example of which is a conduit for the benefit composition 44 (as shown in FIGS. 5 and 8–9, and 12), or a combination thereof. The woven or non-woven sheath may also be used as a method of attaching inner housing 20 and outer housing 50. The inner housing 20 and outer housing 50 may be used to provide a means of gravitational counter-balancing so as to reduce unnecessary tension on the wires and/or the housing connections. Typical weight ratios between the inner housing 20 and the outer housing 50 are generally from about 1:14 to about 14:1. The inner housing 20 and outer housing 50 may also be in electrical and/or fluidic communication.

In the embodiment of FIG. 1, a flat cable 40 is run between the two housings 20 and 50, and travels along the inner surface of the fabric article drying appliance door 15 (see FIG. 8, for example), over the top of the door 15, and down the exterior surface of the door 15. Alternatively, in an embodiment not shown, flat cable 40 may travel through an aperture in the fabric article drying appliance door 15 so as to connect inner housing 20 and outer housing 50. As noted above, housings 20 and 50 may be attached to surfaces of the fabric article drying appliance other than its door 15. Housing 50 may be attached to any exterior surface including a household wall.

Figure 2:
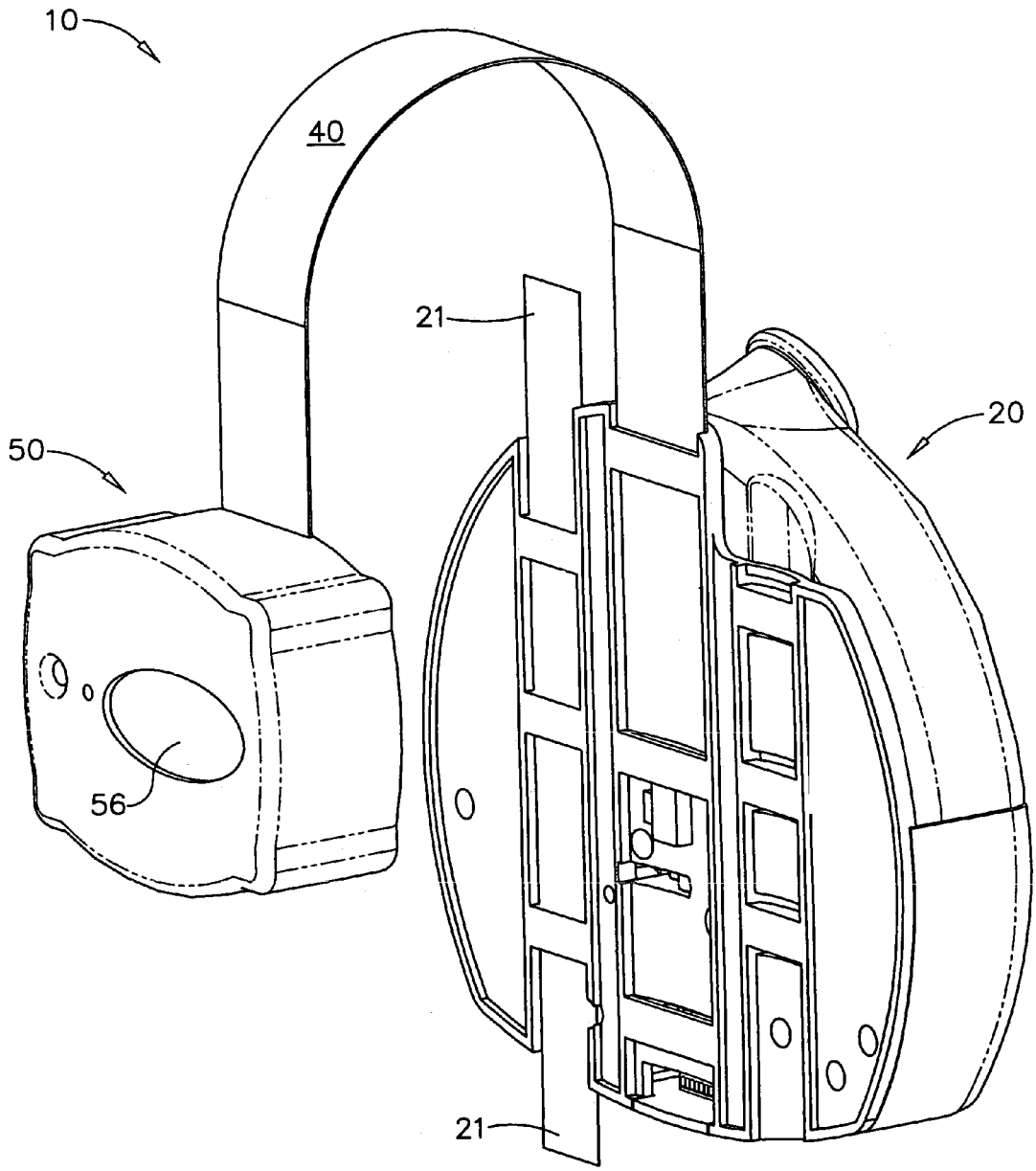
FIG. 2 is a perspective view from the opposite angle of the fabric article treating device of FIG. 1.

Referring to FIG. 2, the flat cable 40 is again visible. Along the surface of the inner housing 20 visible in FIG. 2, a door mounting strap 21 is visible. An end of the mounting strap is also visible in FIG. 1. Certainly other arrangements for attaching the inner housing 20 to a dryer door 15 (or other interior surface) could be arranged without departing from the principles of the present invention.

FIG. 2 shows the same fabric article treating device 10 from an opposite angle, in which the outer housing 50 is provided with a means for activating the treating device 10 as shown at 56. The treating device 10 may be mechanically or electrically activated. In one non-limiting embodiment, a user of the device might depress a button which would then mechanically activate the treating device 10 so as to result in the spraying of benefit composition into the fabric article drying appliance. In another non-limiting embodiment, the treating device may be activated by an ON-OFF switch. The treating device 10 may be operated manually, automatically, or a combination thereof. For instance, the treating device 10 may be manually operated at the user's whim. Alternatively, the treating device 10 can be set to automatically treat at predetermined times and/or intervals.

Figure 3:
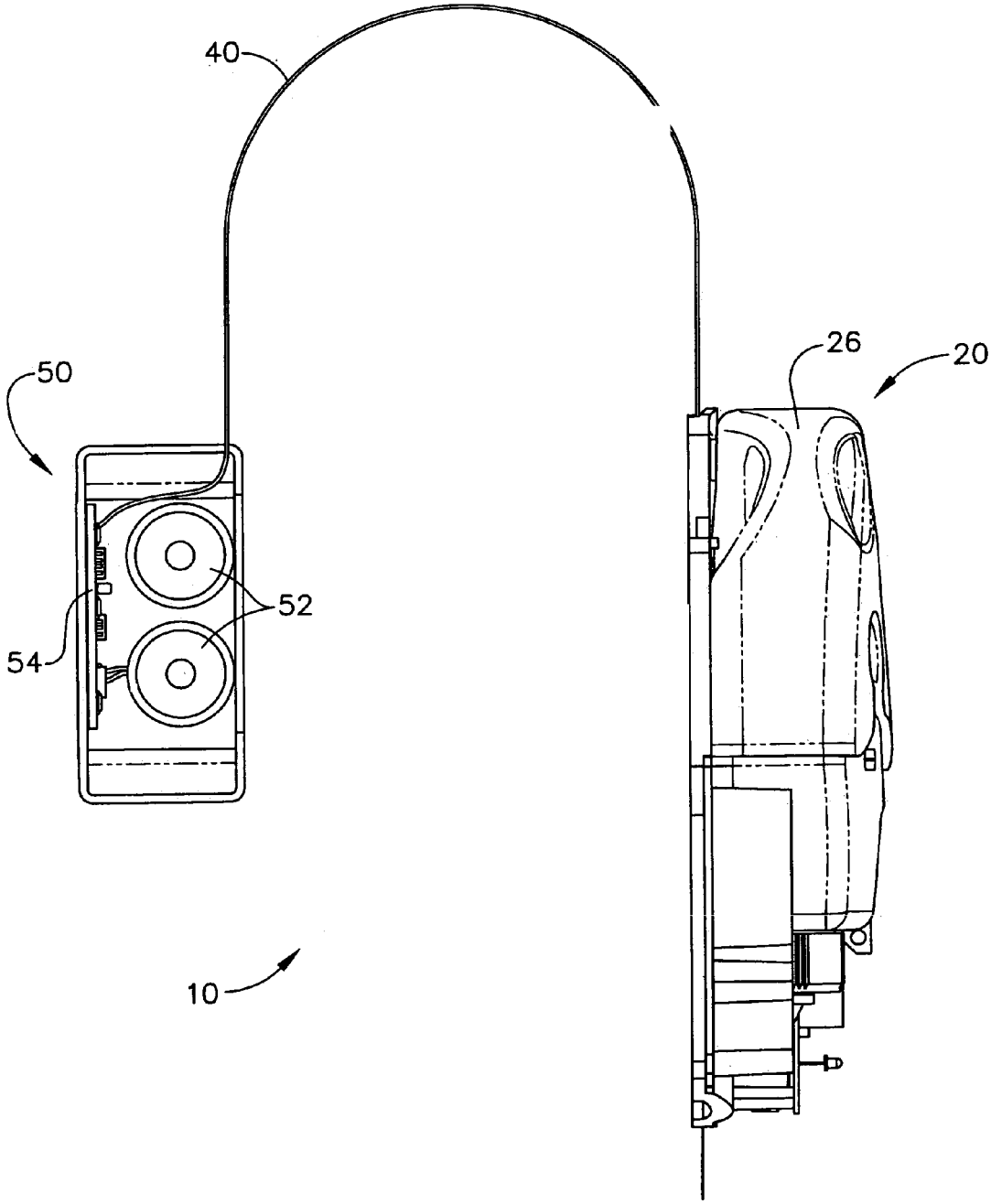
FIG. 3 is an elevational view from one end in partial cross-section of the fabric article treating device of FIG. 1, illustrating the interior housing and exterior housing, as joined together by a flat cable.

Referring now to FIG. 3, the fabric article treating device 10 is illustrated such that the reservoir 26 can be seen as an interior volume of the inner housing 20. In the outer housing 50, a set of batteries 52 may be included. A printed circuit board with electronic components may also be included as shown at 54. The electronic components of one embodiment will be discussed below in greater detail. It will be understood that any electrical power source could be used in the present invention, including standard household line voltage, or even solar power. Batteries may be utilized if it is desired to make the apparatus 10 easily portable, however, any appropriate power adapter can be provided to convert an AC power source to the appropriate DC voltage(s) used in the electronic components on the PC board 54, or to convert a DC power source (including a battery or solar panel) to the appropriate DC voltage(s) used in the electronic components on the PC board 54.

Figure 4:
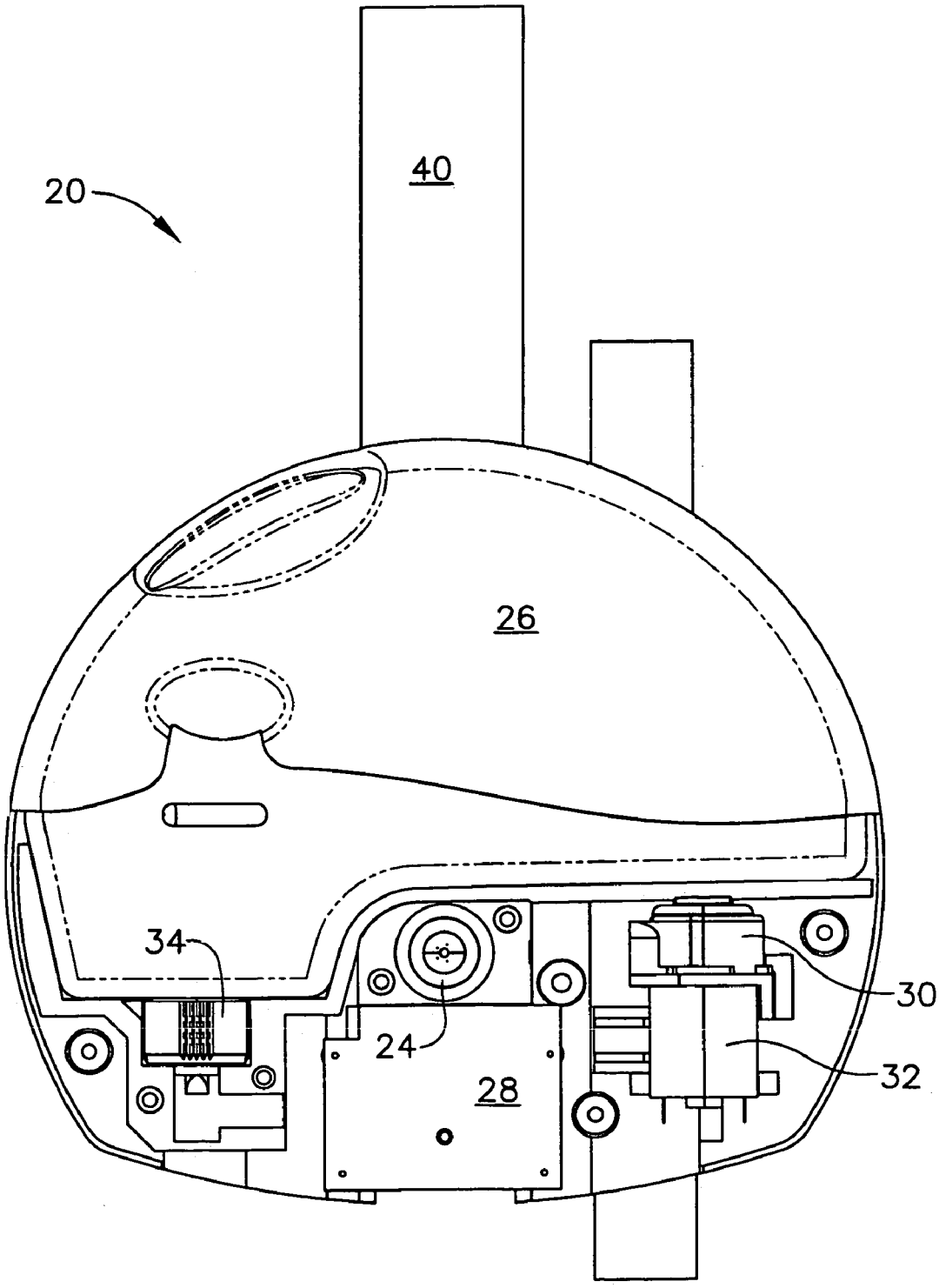
FIG. 4 is an elevational view from one side in partial cross-section of the interior housing portion of the fabric article treating device of FIG. 1.

Referring now to FIG. 4, some of the other hardware devices which may be included are illustrated with respect to the inner housing 20. In the embodiment of FIG. 4, the discharge nozzle 24 acts as an electrostatic nozzle, and thereby is coupled with a high voltage power supply 28, by use of an electrical conductor not shown in this view. A quick disconnect switch 34 may be included, so that the high voltage power supply 28 can be quickly shut down if necessary. A pump 30 is visible in FIG. 4. The pump 30 may be mechanical, electrical, or a combination thereof. FIG. 4 shows pump 30 and corresponding electric motor 32. Some type of dispensing apparatus is used regardless as to whether the discharge nozzle 24 is producing a pressurized spray only, or an electrostatic spray that utilizes a high voltage power supply 28.

Commonly assigned patent application, U.S. Ser. No. 10/418,595, filed Apr. 17, 2003 and entitled "Fabric Article Treating Method and Apparatus," describes a method for treating a fabric article that uses an electrically charged composition that is dispensed through a discharge nozzle.

Figure 5:
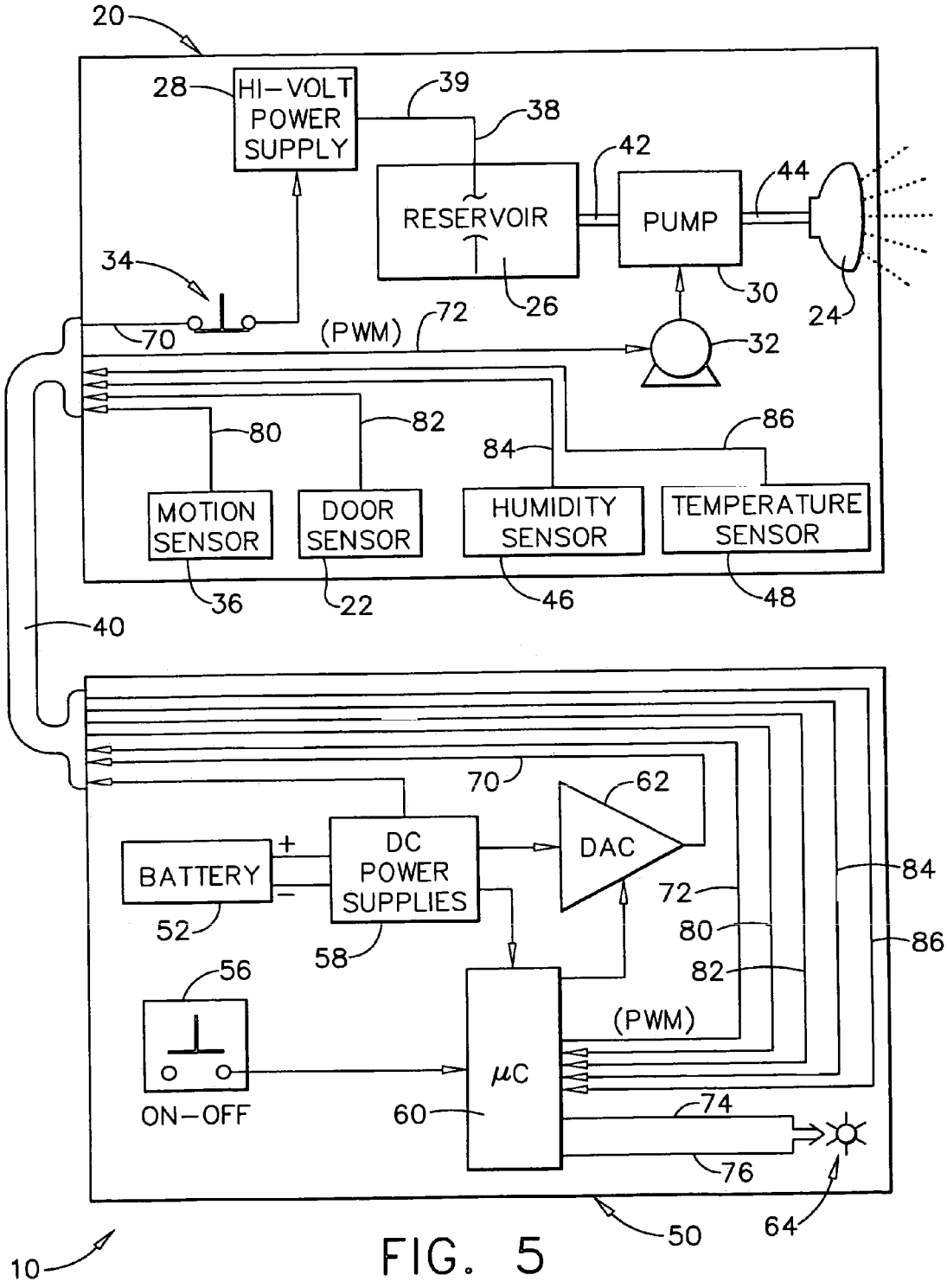
FIG. 5 is a block diagram of some of the electrical and mechanical components which may be utilized in the fabric article treating device of FIG. 1.

FIG. 5 provides a block diagram of some electrical and mechanical components that may be included in fabric article treating device 10, as constructed according to one embodiment of the present invention. A high voltage power supply 28 may optionally be provided in inner housing 20, which may be used to electrically charge a composition that is dispensed through discharge nozzle 24, thus providing for an electrostatic nozzle system if desired. It should be noted that other methods of discharging the benefit composition are also suitable, a non-limiting example of which includes pressure swirl atomizing nozzles. The inner housing 20 utilizes a general body or enclosure to contain the devices needed within the drying appliance. It will be understood that such components will generally be subjected to relatively high temperatures and humidity during the treatment cycle of the drying appliance. Consequently, the more sensitive components of treating device 10 may be mounted in a different location, such as in the outer housing 50.

Furthermore, it may be desirable to locate some of these components in the outer housing 50 for example if they need to communicate with a user of the device. A non-limiting example of such an instance would be mounting LED lights in the outer housing 50 so that they can be viewed by the user while the fabric article drying appliance is in operation. Other non-verbal signals may be used, non-limiting examples of which include sound signals, light signals, vibrations, and the like.

Referring to FIG. 5, a flat cable 40 may be used to connect inner housing 20 with outer housing 50. The flat cable 40 may also be used to bring electrical power into the inner housing 50. Additionally, the flat cable 40 may also be used to bring certain command signals into the inner housing 20. Further, flat cable 40 may be used to receive electrical signals from optional sensors mounted in the inner housing 20 and communicate those sensor signals back to the outer housing 50.

When the optional high voltage power supply 28 is used, a power supply control signal may be used. As shown in FIG. 5, the power supply control signal follows a wire 70 through the quick disconnect switch 34 to the high voltage power supply 28. This signal can comprise a constant DC voltage, a constant AC voltage, a variable DC voltage, a variable AC voltage, or some type of pulse voltage, depending on the type of control methodology selected by the designer of the fabric article treating device 10.

In one embodiment, the signal at 70 may be a variable DC voltage. As the variable DC voltage increases, the output of the high voltage power supply 28 will also increase in voltage magnitude, along a wire 39 that is attached to an electrode 38 that carries the high voltage to the nozzle 24, or into the reservoir 26. The voltage impressed onto the electrode 38 will then be transferred into the benefit composition. Alternatively, a constant output voltage DC high voltage power supply could be used instead of the variable output voltage power supply 28.

Once the benefit composition is charged within the reservoir 26 (alternatively it can also be charged at the nozzle 24) it will travel through a tube or channel 42 to the inlet of the pump 30, after which the composition will be pressurized and travel through the outlet of the pump along another tube (or channel) 44 to the discharge nozzle 24. For use in the present invention, the actual details of the type of tubing used, the type of pump 30, and (if used) the type of electric motor 32 that drives the pump, the type of nozzle 24 that discharges the composition, can be readily configured for almost any type of pressure and flow requirements. If an electric motor 32 is used, the electrical voltage and current requirements of the electric motor 32 to provide the desired pressure and flow on the outlet of the pump 30 can also be readily configured for use in the present invention. Virtually any type of pump and electric motor combination or stand-alone pump (i.e.; without an associated electric motor) can be utilized in some form or another to create a useful device that falls within the teachings of the present invention.

It should be noted that some types of pumps do not require separate input and output lines or tubes to be connected thereto, such as peristaltic pumps, in which the pump acts upon a continuous tube that extends through an inlet opening and continues through a discharge opening of the pump. This arrangement may be used with electrostatically charged fluids or particles that are being pumped toward the discharge nozzle 24, because the tubing can electrically insulate the pump from the charged benefit composition, or in other situations where it may be desired to protect the pump from the composition. It should also be noted that a mechanical (i.e.; non-motorized pump) could be used, if desired, such as a spring-actuated pumping mechanism. A non-limiting example of a suitable peristaltic pump is the 10/30 peristaltic pump, which may be readily obtained from Thomas Industries of Louisville, Ky.

When used, the types of control signals that may be utilized to control the electric motor 32 can vary according to the design requirements of the treating device 10. Such signals will travel along an electrical conductor 72 to control motor 32, via the flat cable 40. If the motor 32 is a DC variable-speed motor, then a variable "steady" DC voltage can be applied, in which the greater the voltage magnitude, the greater the rotational speed of the motor. In one embodiment, the electrical signal traveling along conductor 72 can be a pulse-width modulated (PWM) signal, that is controlled by a microprocessor or a microcontroller. Of course, such a pulse-width modulated signal can also be controlled by discrete logic, including analog electronic components.

The fabric article treating device 10 can include optional sensors. Non-limiting examples of optional sensors include a door (or lid) sensor 22, a motion sensor 36, a humidity sensor 46, and/or a temperature sensor 48. One non-limiting example of a door/lid sensor 22 could be an optoelectronic device, such as an optocoupler or an optical input sensor, e.g., a phototransistor or photodiode. When the door/lid of the drying appliance is opened, then the door sensor 22 will change state, and will output a different voltage or current level along an electrical conductor 82 that leads from door sensor 22 back to the controller in the outer housing 50. This can be used as a safety device to immediately interrupt the discharge spray emanating from the nozzle 24. The optional door sensor 22 could be utilized even when a control system such as that shown in FIG. 5 is integrated into the overall "conventional" control system of a drying appliance. A drying appliance would normally have its own door sensor that for example shuts off the rotating drum of a dryer when the door becomes opened. In this instance, optional door sensor 22 can act as a back-up (or second) door sensor to the dryer's internal "original" sensor that shuts off the drum. One example which could be used as a door/lid sensor is an NPN phototransistor, part number PNA1801L, manufactured by Panasonic, of Osaka, Japan.

An alternative configuration for providing an optional "door" sensor is to use a pressure-sensitive conductor within the flat cable 40. The electrical characteristics of this pressure-sensitive conductor will vary between a first condition in which the door is open, and a second condition in which the door is closed. This type of circuit can act, in essence, like a strain gauge that varies with a change in contact pressure. A low voltage biasing current may be run through the pressure-sensitive conductor to provide an output signal that is detected by the control circuit of treating device 10. An optional door sensor such as a pressure-sensitive door sensor in cable 40 could eliminate the need for an optional optical-sensitive sensor, such as that described in the preceding paragraph, or it may be used to complete the operation of the optional aforementioned optical-sensitive sensor.

Another type of optional sensor that can be utilized by the treating device 10 of the present invention is a motion sensor 36. For fabric article drying appliances which utilize a moving interior, such as a dryer, the motion sensor 36 can detect if the fabric article drying appliance is in use. For example, referring to FIG. 2, if a person was to activate the treating device 10 by the activation means shown at 56, (for example by actuating an ON-OFF switch), but the fabric article drying appliance itself was not in use, then it may be desirable for the nozzle 24 to, be prevented from discharging any of the benefit composition. The optional motion sensor 36 could output an electrical signal along a conductor 80 that feeds into the controller of the outer housing 50.

One example of a motion sensor is a vibration and movement sensing switch manufactured by ASSEMtech Europe Ltd., of Clifton, N.J., available as Model No. CW1600-3. Another type of optional motion sensor that may be used in the present invention uses a light source to direct (infrared) light at a surface, and the relative motion of that surface can be detected by the intensity and/or frequency of the returning light. Such sensors can measure the actual speed of rotation, if that information is desired.

Another optional sensor that could be used with the fabric article treating device 10 of the present invention is a humidity sensor 46. The optional humidity sensor 46, could be used to control the amount of composition being discharged by the nozzle 24, and also could be utilized to determine the proper environmental conditions during an operational cycle that the dispensing events should take place. Additionally, this humidity sensor may be used to maintain a specified humidity by controlling the dispensing of the benefit composition such that optimal de-wrinkling and/or other benefits are achieved. Many different types of humidity sensors could be used in conjunction with the present invention, including variable conductivity sensors. One such sensor is sensor manufactured by Honeywell, of Freeport, Ill., under the Model No. HIH-3610-001, although any of the HIH-3610 Series may be used.

Referring to FIG. 5, the optional humidity sensor 46 provides an output signal along an electrical conductor 84 that leads back to the controller of the outer housing 50. If the humidity sensor 46 is purely a variable conductance (or variable resistance) device, then some type of interface circuit would be necessary to provide some biasing current or biasing voltage to generate an output signal (as a current or voltage) that can be input on conductor 84 to the controller (e.g., the electronics on PC board 54—see FIG. 3).

A further optional sensor that could be useful in the treating device 10 of the present invention is a temperature sensor 48, such as one that outputs an analog signal along the electrical conductor 86 that leads back to the controller in the outer housing 50. (It should be noted that some temperature sensors have a serial bus to carry a digital output signal, rather than outputting an analog voltage.) The optional temperature sensor 48 may not be necessary for many of the control features of the treating device 10, however, the interior temperature of the drying appliance could be used to determine the proper environmental conditions for certain dispensing events to occur, particularly if a "final" dispensing event of the benefit composition in reservoir 26 is to take place during a "cool down" cycle of the drying appliance. In addition, the temperature sensor 48 can also be used as an indicator that the drying appliance is operating properly. For example if the drying appliance has not warmed up to a predetermined minimum temperature, then its heating element (or burner) may not be working correctly.

Referring to FIG. 5, the components of the exterior housing 50 may optionally include heat and/or humidity sensitive components, non-limiting examples of which include electronics 54 and power source 52. For example, if power source 52 comprises four D-cell batteries connected in series, a +6 volt DC voltage will be provided to a set of DC power supplies generally designated by the reference numeral 58. The schematic drawings provided in FIGS. 6A–6C and 7 show these power supplies 58 in greater detail. One of the DC power supply voltages could for example provide energy for an optional high voltage power supply 28, via the electrical conductor 70 that runs through the flat cable 40. Another output voltage may be provided to a microcontroller 60, which in the non-limiting exemplary embodiment depicted in FIGS. 6A–6C, requires a +3.3 volt DC power supply. In the non-limiting exemplary embodiment of FIGS. 6A–6C, a digital-to-analog converter (DAC) 62 is used, and the device provided by Analog Devices of Norwood, Mass. (Part No. AD 5301), requires a +5 volt DC power supply. All of these power supplies are provided by the "set" of DC power supplies 58.

Figure 6A:
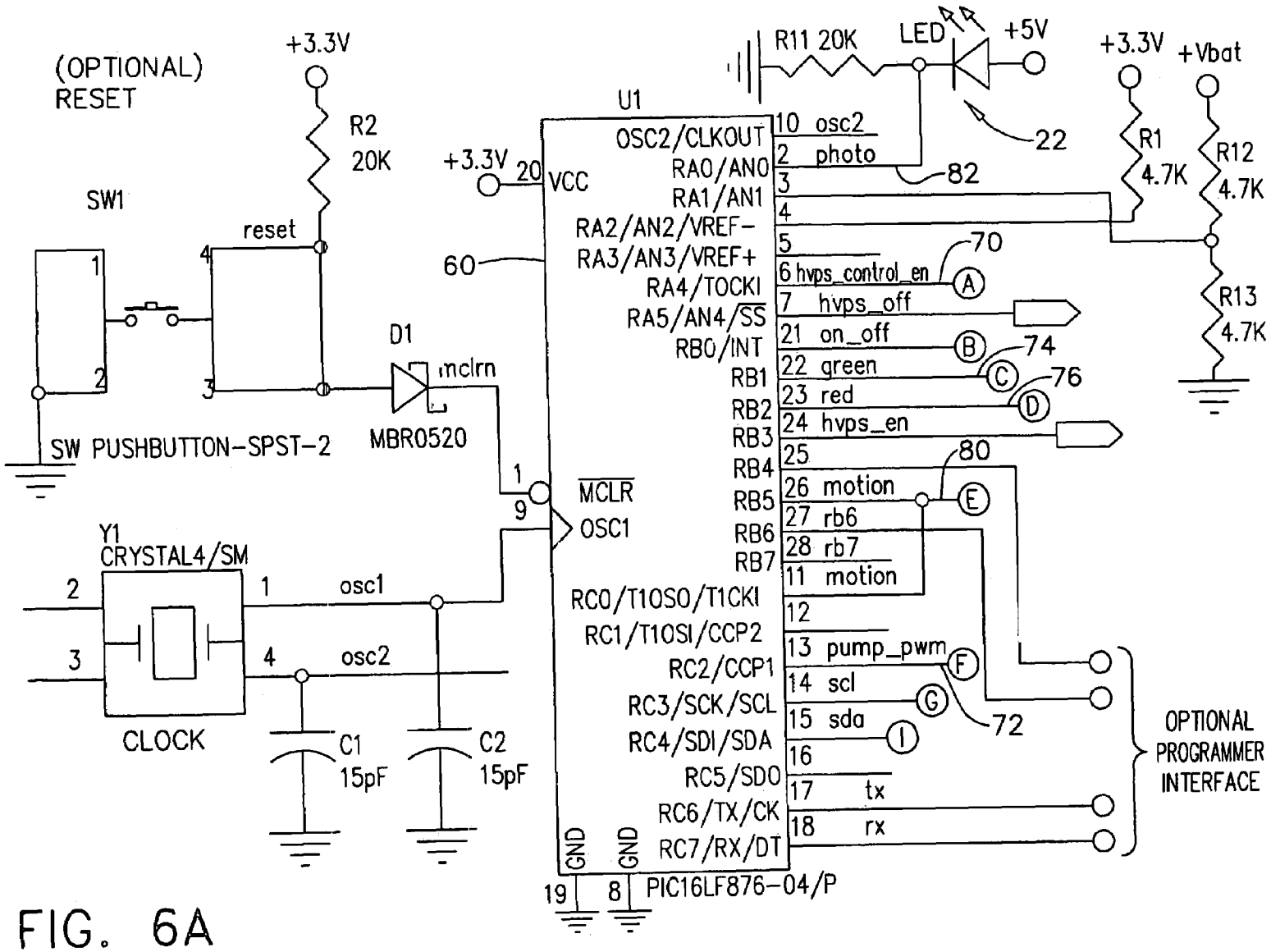
FIG. 6 (comprising FIGS. 6A, 6B, and 6C) is a schematic diagram of a first portion of an electronic controller which may be utilized in the fabric article treating device of FIG. 1.
Figure 6B:
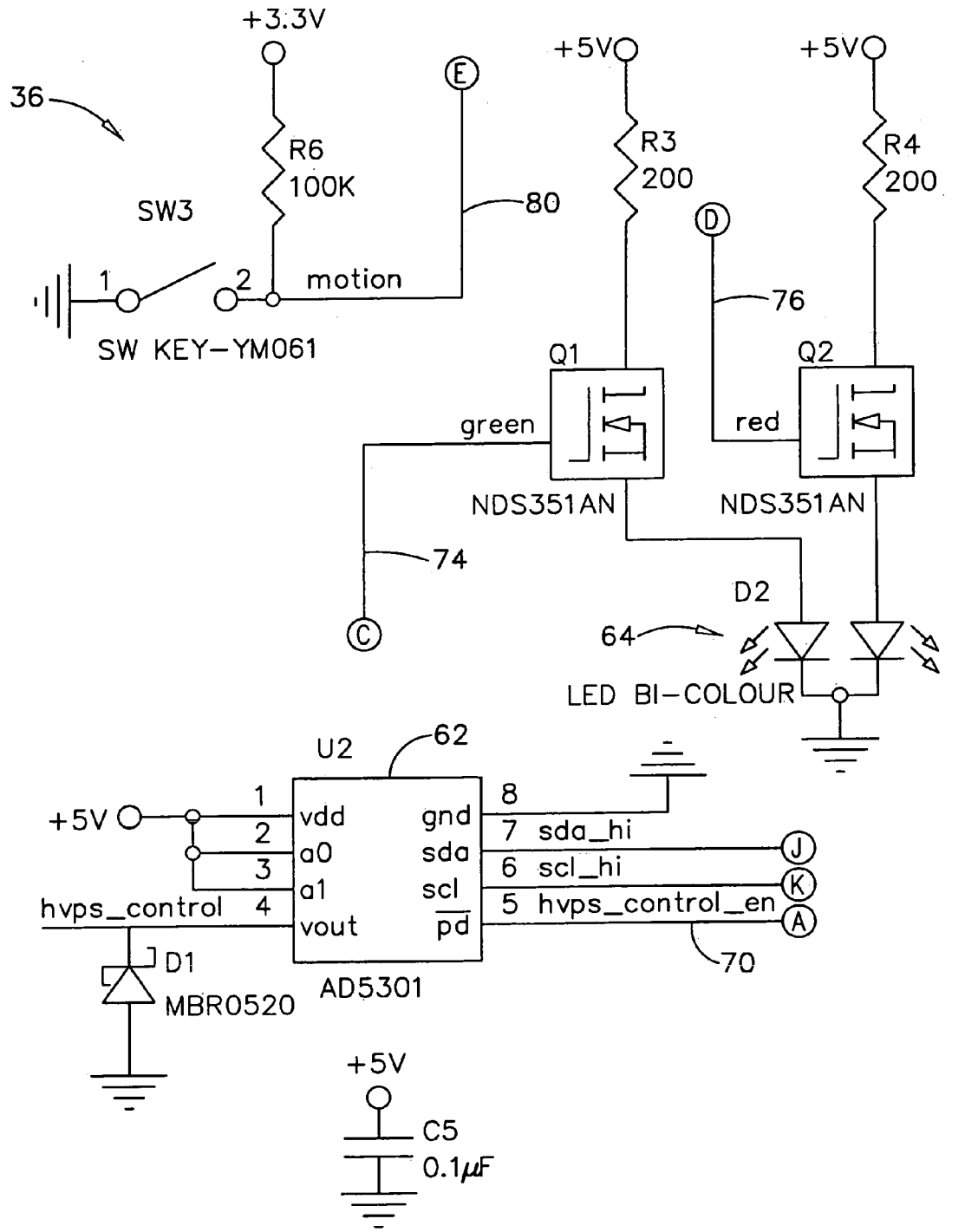
Figure 6C:
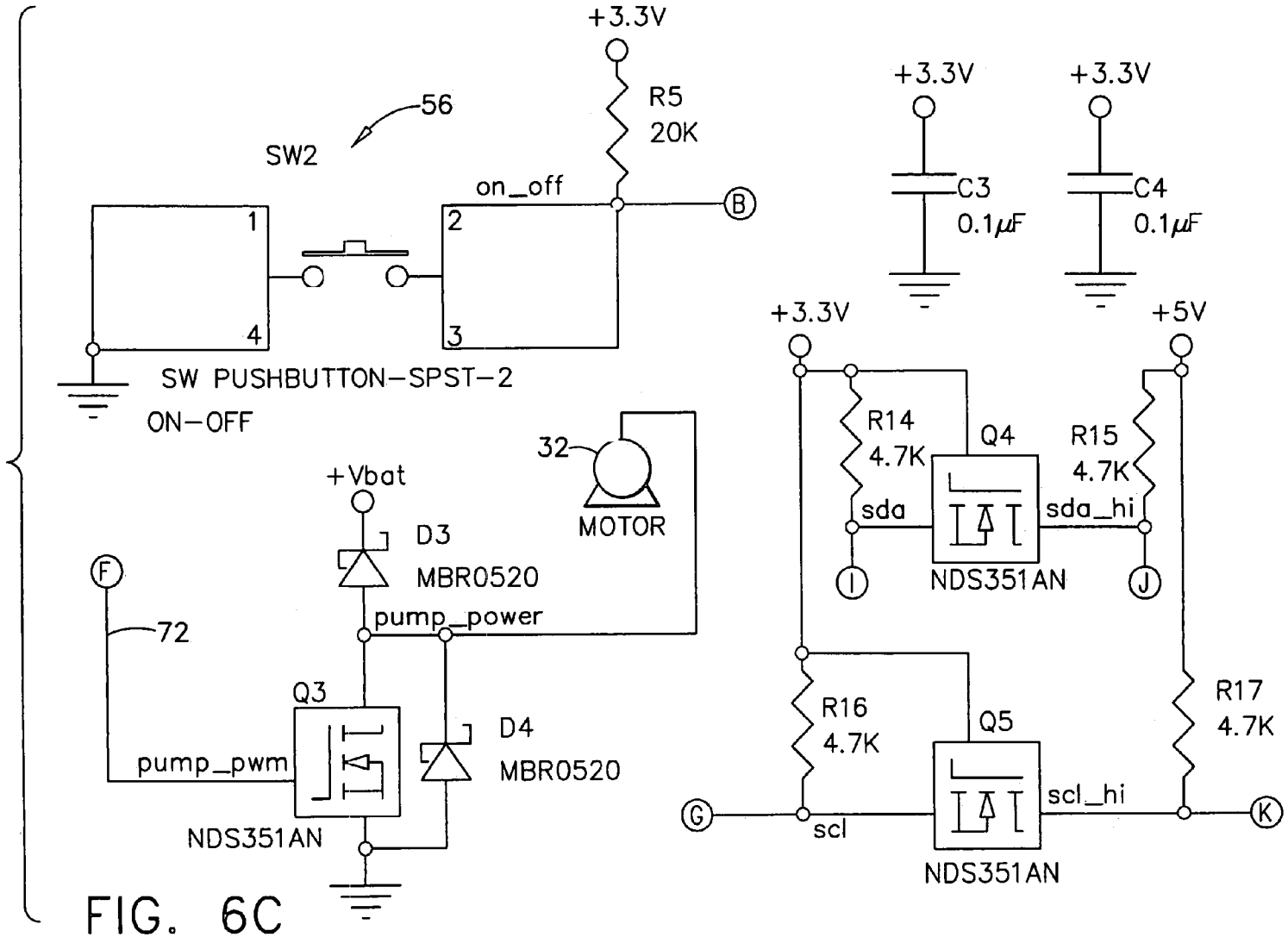

Referring now to FIGS. 6A–6C, a component which may optionally be used for controlling the treating device 10 is a microcontroller 60. A suitable microcontroller 60 is manufactured by Microchip of Chandler, Ariz., under the Part No. PIC16LF876-04/P. However, other microcontrollers made by different manufacturers could also easily be used. Microcontroller 60 includes on-board Random Access Memory (RAM), on-board FLASH Memory, which comprises electrically programmable non-volatile memory elements, as well as on-board input and output lines for analog and digital signals. The microcontroller 60 may also be used with a crystal clock, oscillator, although an RC circuit could instead be used as a clock circuit, if desired. The clock circuit provides the timing clock pulses necessary to operate the microcontroller 60. The PIC16LF876 microcontroller also has a serial port that can be interfaced to an optional programmer interface using an RS-232 communications link.

It will be understood that the microcontroller 60 could be virtually any type of microprocessor or microcontroller circuit commercially available, either with or without on-board RAM, ROM, or digital and analog I/O. Moreover, a sequential processor is not necessarily required to control the treating device 10, but instead a parallel processor architecture could be used, or a logic state machine architecture could be used. Furthermore, the microcontroller 60 could be integrated into an Application Specific Integrated Circuit (ASIC) that could contain many other logic elements that can be used for various functions, such functions being optional depending upon the model number of the treating device 10 that will be sold to a consumer. To change model number features, the manufacturer need only program the ASIC (or the on-board ROM of a microcontroller) according to the special parameters of that particular model, while using the same hardware for each of the units.

It will also be understood that discrete digital logic could be used instead of any type of microprocessor or microcontroller unit, or even analog control circuitry could be used along with voltage comparators and analog timers, to control the timing events and to make decisions based on the input levels of the various sensors that are provided with the treating apparatus 10.

FIGS. 6A–6C also includes an optional reset switch designated SW1. Such a reset switch may not be desired for a consumer apparatus. The ON-OFF switch 56 may be interfaced to one of the I/O inputs to the microcontroller 60. Optionally, a number of other inputs may be provided to the microcontroller, including a door sensor 22, which in FIGS. 6A–6C is depicted as an optical sensor that provides a signal along the conductor 82. Motion sensor 36 which may be optionally included, outputs a signal along the conductive pathway 80 to the microcontroller 60. Other inputs not depicted on FIGS. 6A–6C could include optionally analog inputs for the temperature and humidity sensors, respectively.

Microcontroller 60 may also control certain outputs, including for example a pulse-width modulated (PWM) signal along conductor 72 that drives a transistor Q3, which converts the signal to a higher voltage and greater current that drives the motor 32. Other digital outputs from the microcontroller 60 run through a voltage shifting circuit of transistors Q4 and Q5, which shifts the signals from 3.3 volt logic levels to +5 volt logic levels to control the DAC 62. Depending upon the states of these signals, the output of DAC 62 may be an analog voltage along the conductive pathway 70 that controls the high voltage DC power supply's output voltage magnitude, as discussed above. As also discussed above, this DAC 62 may not be required for full production units, particularly if it is determined that a constant DC output voltage will be preferred as supplied by the high voltage DC power supply 28 (see FIG. 7). This can be determined by the system designer.

The microcontroller 60 may also optionally output two control signals to a visual indicator with two LEDs of two different colors. In this non-limiting example embodiment, the LEDs used are green and red. The output signal along a conductive pathway 74 drives a solid state transistor Q1, which will turn on a green LED, as desired. Another output signal along a conductive pathway 76 drives a solid state transistor Q2 that provides current to drive a red LED. Both the red and green LEDs may be part of a single bi-color device, generally designated by the reference numeral 64. When desired, the green light may be displayed to the user, or the red light may be displayed. Also, both LEDs can be energized simultaneously, which will produce a yellow color discernible by a human user.

As a non-limiting example of how the optional bi-color LED 64 could be used, a steady green color could represent an "ON" signal for the fabric article treating apparatus 10. If the motion sensor 36 is discerning movement in the dryer that sets up a sufficient vibration to actuate the motion sensor 36 itself, then the green light could be flashing, for example. This could be a normal state for using the treating device 10. During "spraying events" both the red and green LEDs could be energized, thereby showing a yellow color. This may inform the user that the spray droplets are actually being dispersed by the nozzle 24. If the door is opened, then the bi-color LED 64 could show a red color. If the battery voltage falls below a predetermined threshold, then the bi-color LED 64 could emit a flashing red light discernible by the user. These are just examples of possible indications for various operating modes. The colors of steady or flashing lights in various colors is completely up to the system designer and has much flexibility. There are also many other methods of presenting operational/signaling information to the user, including but not limited to an LCD display, or multiple individual lamps or LED's, vibrational techniques, and/or auditory signaling techniques of which such alternative methodologies fall within the scope of the present invention.

Figure 7:
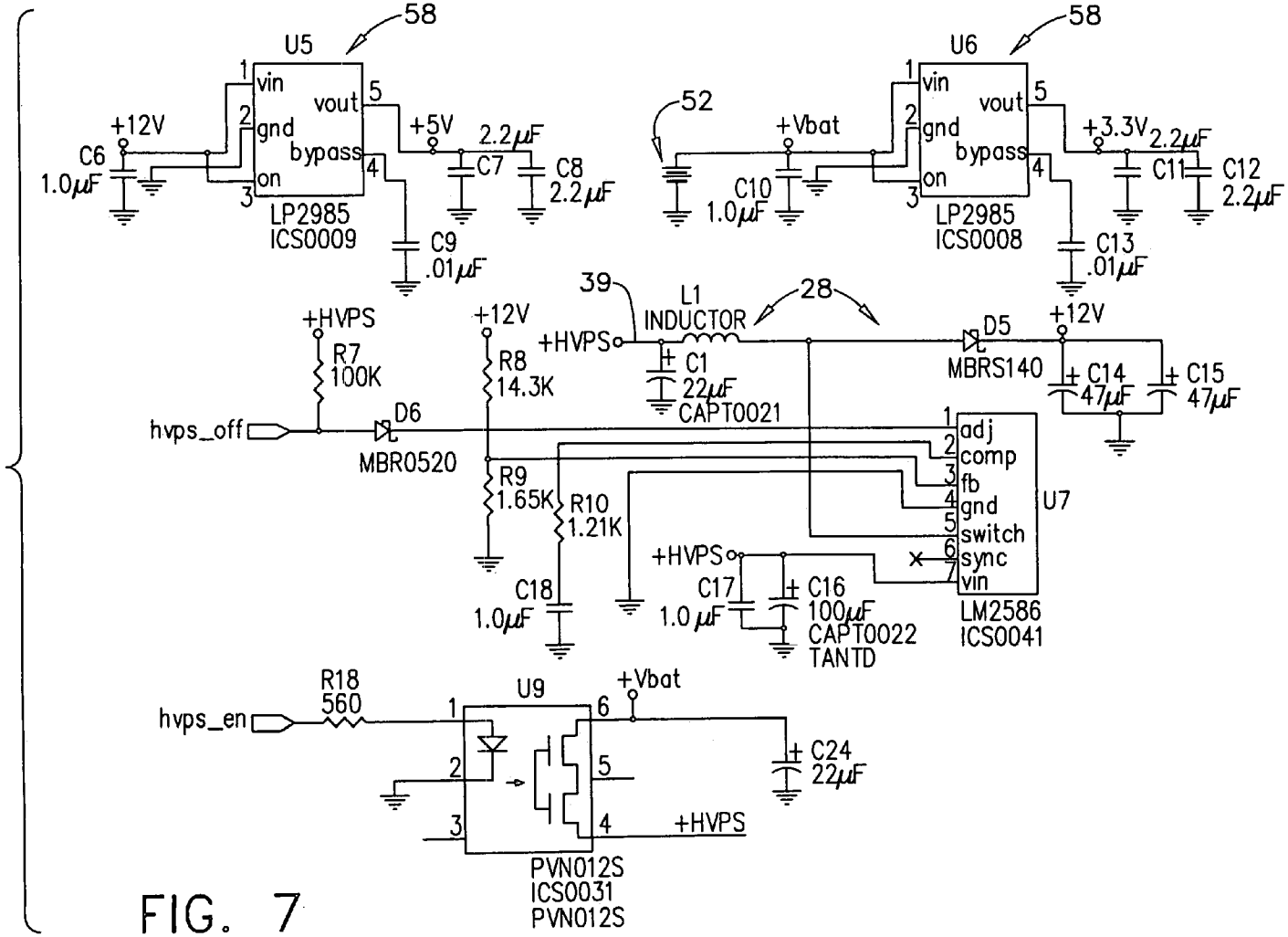
FIG. 7 is an electrical schematic diagram of other portions of an electronic controller, including power supply components, which may be utilized in the fabric article treating device of FIG. 1.

Referring to FIG. 7, power supply circuits 58 may be used in the fabric article treating device 10 of the present invention. The battery voltage may be used to drive a voltage regulator U6, which outputs a +3.3 DC volt power supply rail. The regulator in this embodiment may be an integrated circuit chip, such as Part No. LP2985 which may be obtained from National Semiconductor, of Santa Clara, Calif. Another voltage regulator chip U5, may be used to provide a +5 volt rail from a +12 volt power supply voltage, which may be another LP2985 regulator device (also available from National Semiconductor). A boost switching regulator, which uses a +12 volt DC input power supply voltage and a switching regulator chip U7, which is an integrated circuit chip, Part No. LM2586 device may also be used as shown in FIG. 7. Such voltage regulator chips are available from National Semiconductor as well as other semiconductor manufacturers. The boost regulator is generally designated by the reference numeral 28, which is referred to in the earlier figures as the high voltage power supply. The output voltage is located at the node indicated by the reference numeral 39, and this represents an electrical conductor that carries the high voltage to the electrode 38 that charges the benefit composition in the reservoir 26, or at the nozzle 24. FIG. 7 also shows a solid state relay U9 that may be used to directly provide current for the high voltage power supply rail (i.e., conductor 39) from the battery voltage.

FIG. 8 diagrammatically shows the general location of some of components which may be included in one of the embodiments of the fabric article treating apparatus 10 of the present invention. As discussed above, sensitive components such as heat sensitive components (non-limiting examples of which may include electronics 54 and batteries 52), humidity sensitive components, and/or components that indicate to the user the operating status of the device 10 may be located within the outer housing 50. The outer housing 50 is connected to the inner housing 20. The outer housing 50 may be electrically connected to the inner housing 20. A flat cable 40 is one non-limiting means of connecting inner housing 20 with outer housing 50. The flat cable 40 may be used to carry power supply between the outer housing 50 and the inner housing 20. The flat cable 40 may also be used to carry input/output signals between the outer housing 50 and the inner housing 20.

The inner housing 20 may contain one or more of the following: reservoir 26, pump 30, discharge nozzle 24 and optional components including electric motor 32, high voltage power supply 28, and various sensors that may or may not be included for a particular version of the treating apparatus 10. When high voltage power supply 28 is included, electrical conductor 39 may also be used to carry the high voltage to the nozzle 24. Alternatively, the high voltage could be carried to reservoir 26. Yet further, the high voltage could be carried to both nozzle 24 and reservoir 26. The tubing 42 to the inlet of the pump is illustrated, as well as the tubing 44 from the outlet of the pump that provides the benefit composition to the nozzle 24. As indicated above, the high voltage power supply 28 is optional within the teachings of the present invention. If spray droplets/particles emitted from the nozzle 24 are not to be electrostatically charged, then there is no need for a high voltage power supply within the inner housing 20.

Figure 12:
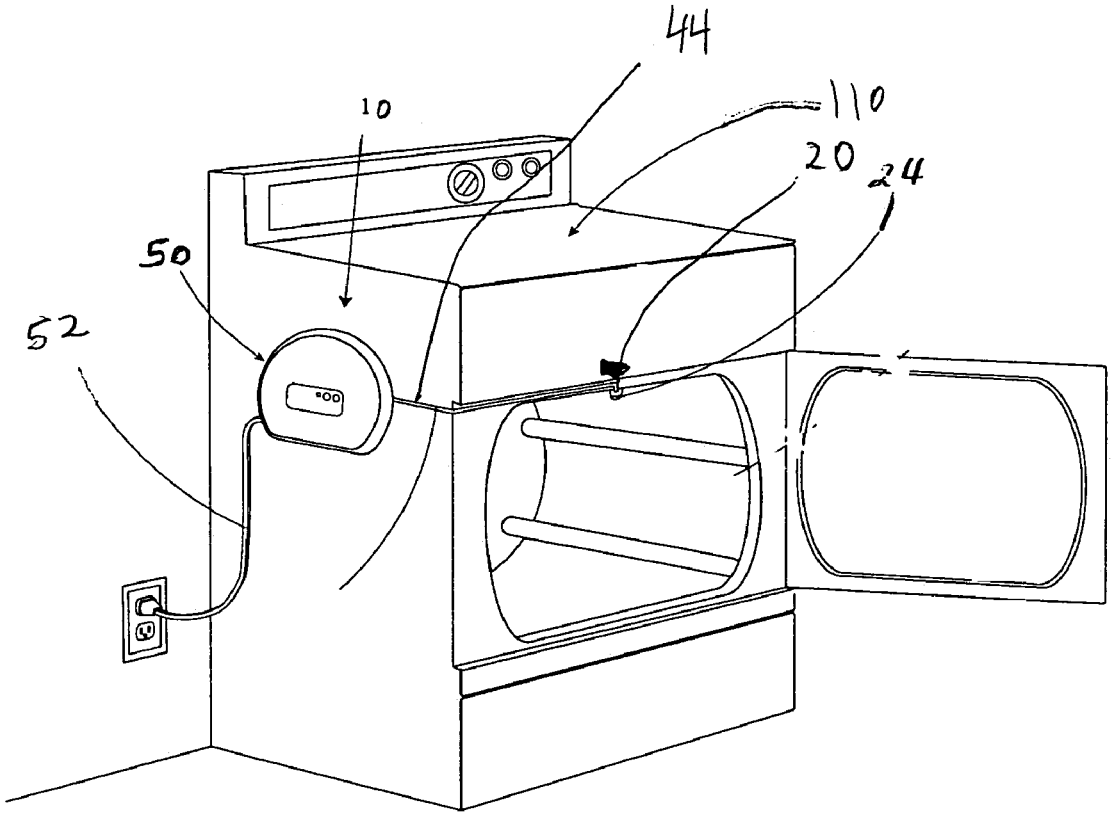
FIG. 12 is a perspective view of system for treating fabric articles in accordance with the present invention.

In another non-limiting embodiment of the present invention as illustrated by FIGS. 9–12, the inner housing 20 comprises a nozzle 24 for discharging the benefit composition in the interior of the fabric article drying appliance. In this embodiment, the pump 30 and reservoir 26 located in outer housing 50 are in communication with nozzle 24 located in inner housing 20 via conduit 44. Benefit composition is carried from reservoir 26 to pump 30 in the outer housing 50 through conduit 44 to nozzle 24 in inner housing 20. FIG. 12 provides additional illustration of this embodiment wherein the outer housing 50 of the treating device 10 is attached to the side wall of a fabric article drying appliance 110 and is in communication with the inner housing 20 by means of a conduit 44. In this embodiment, the inner housing 20 comprises a nozzle 24.

Figure 13:
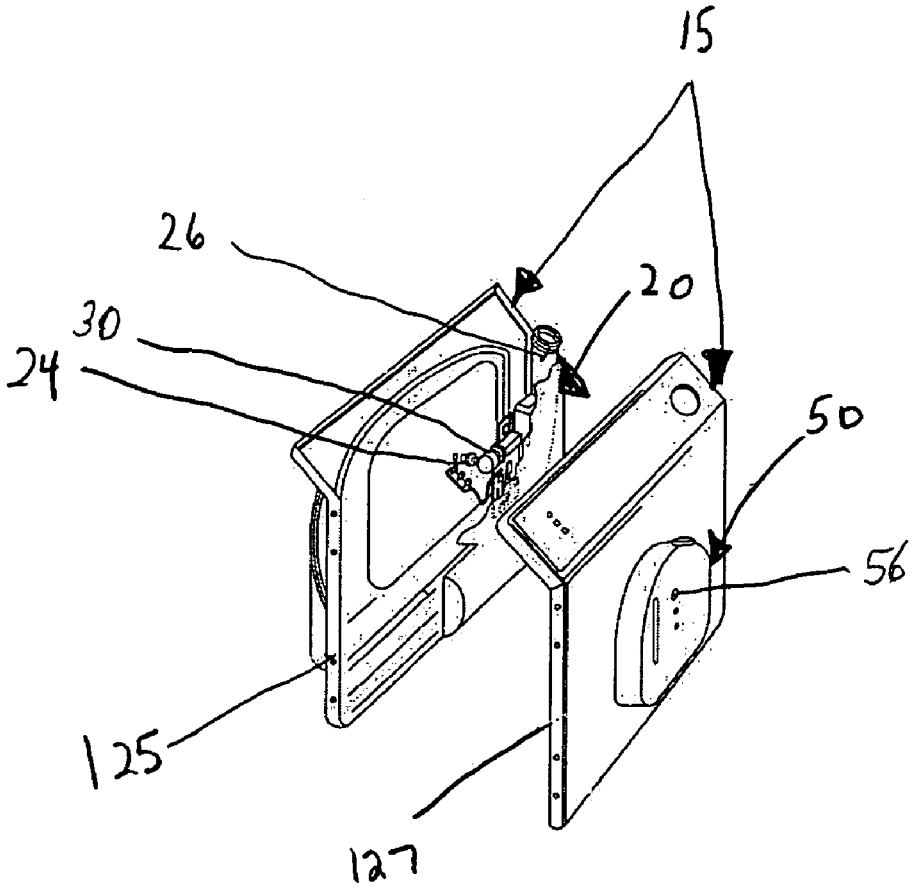
FIG. 13 is an exploded view of another embodiment of the fabric article treating device of the present invention.

In a further embodiment as shown in FIG. 13, the outer housing 50 is located on the exterior of fabric article drying appliance door 15. The inner housing 20 is located between the exterior surface 127 and interior surface 125 of fabric article drying appliance door 15. Inner housing 20 is in communication with outer housing 50. In this embodiment, inner housing 20 is in electrical communication with outer housing 50. ON-OFF switch 56 is located in outer housing 50. Reservoir 26, pump 30, discharge nozzle 24, and power source 52 are located in inner housing 20. Benefit composition is moved from reservoir 26 through pump 30 and out through discharge nozzle 24 into the fabric article drying appliance.

It will be understood that when electrical energy is utilized, the source of electrical energy used by the present invention may be provided in many different forms. For example, a battery (or set of batteries) can be used, such as the set of batteries 52, described above. However, as shown in the non-limiting embodiment of FIG. 10, standard line voltage could instead be used, such as 120 VAC, single phase power, at 60 Hz; or in Europe, the line voltage would likely be at 220 VAC at 50 Hz. For some installations, a more exotic source of electrical energy could be provided, such as a solar panel comprising photovoltaic cells or photoconductive cells.

Also when using a pump 30 which is motorized, a variable or fixed speed motor 32 may optionally be used for driving the pump 30. The motor 32 may optionally be energized by use of a pulse-width modulation control scheme. If the motor 32 is energized by use of a pulse-width modulation control scheme (hereinafter "PWM"), the PWM duty cycle can be increased as the battery voltage begins to decrease. This will have the effect of controlling the effective output provided by the pump 30, and will attempt to keep the output volume of the pump 30 substantially constant, even when the battery voltage begins to drop as the battery 52 discharges. At the same time, if a high voltage power supply 28 is used that has a variable output voltage that can be controlled, then that output voltage could also be "increased" as the battery voltage begins to fall, so that the effective output voltage will remain substantially constant, if desired by the system designer. As an alternative design, the input voltage driving the high voltage power supply 28 could be increased as the battery voltage starts to decrease, thereby keeping the voltage to the motor 32 (or to a piezo pump 30—see below) substantially constant.

As noted above, one type of pump 30 that can be used in the present invention is a peristaltic pump, including for use in an electrostatic spraying application. Another type of pump 30 usable in the present invention is an ultrasonic piezo pump, which has no major moving parts. While certain membranes or laminations (or other types of layers) may vibrate in a reciprocating-type fashion, the piezo pumps do not have major moving parts that can wear out, such as rotating shafts and bearings used with a rotary member to displace a liquid or gaseous fluid. One suitable piezo pump usable in the present invention is manufactured by PAR Technologies, LLC, located in Hampton, Va., and in particular PAR Technologies' "LPD-series" laminated piezo fluid pumps. Pumps manufactured by PAR Technologies can be obtained which draw a relatively low current. Such piezo pumps would not require a separate motor, such as the motor 32 depicted in FIG. 5.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric article treating device, said fabric article treating device comprising:

a portable apparatus comprising:

a) an unitary interior housing, for location inside of a fabric article drying appliance wherein said interior housing of said portable apparatus includes a nozzle for delivering a benefit composition into the drum of a fabric article drying appliance and wherein said interior housing of said portable apparatus is releasably attachable to the interior of a fabric article drying appliance; and b) an unitary exterior housing for location outside of a fabric article drying appliance;

wherein said interior housing of said portable apparatus and said exterior housing of said portable apparatus are in communication with one another and wherein a reservoir is contained within said exterior housing of said portable apparatus, within said interior housing of said portable apparatus, or a combination thereof.

2. The fabric article treating device of claim 1 wherein said interior housing and said exterior housing are in electrical communication with one another.

3. The fabric article treating device of claim 2 further comprising a power source wherein said power source is located in said exterior housing.

4. The fabric article treating device of claim 1 wherein said interior housing and said exterior housing are in compositional transfer communication.

5. The fabric article treating device of claim 1 wherein said interior housing and said exterior housing are in thermal communication.

6. The fabric article treating device of claim 1 wherein said fabric article drying appliance further comprises a closure structure and wherein said interior housing is located between the interior and exterior surfaces of said closure structure.

7. The fabric article treating device of claim 1 further comprising sensitive components wherein said sensitive components comprise components that are sensitive to heat, components sensitive to humidity, or a combination thereof.

8. The fabric article treating device of claim 1 wherein said fabric article treating device is mechanically or electrically activated.

9. The fabric article treating device of claim 1 further comprising a benefit composition wherein said benefit composition is electrically charged.

10. The fabric article treating device of claim 1 further comprising sensors.

11. A fabric article treating device, said fabric article treating device comprising:

a portable apparatus comprising:

a) an unitary interior housing, for location inside of a fabric article drying appliance wherein said interior housing of said portable apparatus includes a nozzle for delivering a benefit composition into the drum of a fabric article drying appliance and wherein said interior housing of said portable apparatus is releasably attachable to the interior of a fabric article drying appliance; and b) an unitary exterior housing for location outside of a fabric article drying appliance;

wherein said interior housing of said portable apparatus and said exterior housing of said portable apparatus are connected to one another so as to be in communication with one another wherein said exterior housing of said portable apparatus includes sensitive components, components used to communicate with a user, or a combination thereof and wherein a reservoir is contained within said exterior housing of said portable apparatus, within said interior housing of said portable apparatus or a combination thereof.

12. The fabric article treating device of claim 11 wherein said interior housing and said exterior housing are connected to one another with a flat cable, a wire, a wire or group of wires encased in a sheath of woven or non-woven material, a conduit, or a combination thereof.

13. The fabric article treating device of claim 11 wherein the connection between said inner housing and said exterior housing comprises a gravitational counter balance.

14. A system for treating fabrics, said system for treating fabrics comprising:

a) a fabric article drying appliance; and b) a portable fabric article treating device comprising:

i) an unitary interior housing, wherein said interior housing is for location inside of said fabric article drying appliance and wherein said interior housing of said portable fabric article treating device includes a nozzle for delivering a benefit composition into the drum of said fabric article drying appliance and wherein said interior housing of said portable fabric article treating device is releasably attached to the interior of said fabric article drying appliance and;

ii) an unitary exterior housing for location outside of said fabric article drying appliance;

wherein said interior housing of said portable fabric article treating device and said exterior housing of said portable fabric article treating device are in communication with one another and wherein a reservoir is contained within said exterior housing of said portable fabric article treating device, within said interior housing of said portable fabric article treating device, or a combination thereof.

15. The system of claim 14 wherein said fabric article drying appliance is a clothes dryer.

16. The system of claim 14 wherein said interior housing and said exterior housing are connected to one another with a flat cable, a wire, a wire or group of wires encased in a sheath of woven or non-woven material, a conduit, or a combination thereof.

17. The system of claim 14 wherein said interior housing and said exterior housing are in electrical communication with one another.

18. The system of claim 14 wherein said fabric article drying appliance further comprises controls and wherein said fabric article treating device is operated substantially independent of said controls.

19. A method for treating fabrics said method comprising:

a) providing a fabric article drying appliance;

b) providing a portable fabric article treating device wherein said fabric article treating device is comprised of:

i) an unitary interior housing for location inside of said fabric article drying appliance wherein said interior housing of said portable fabric article treating device includes a nozzle for delivering a benefit composition into the drum of said fabric article drying appliance and wherein said interior housing of said portable fabric article treating device is releasably attachable to the interior of said fabric article drying appliance; and ii) an unitary exterior housing for location outside of said fabric article drying appliance;

wherein said interior housing of said portable fabric article treating device and said exterior housing of said portable fabric article treating device are in communication with one another and wherein a reservoir is contained within said exterior housing of said portable fabric article treating device, within said interior housing of said fabric article treating device, or a combination thereof;

c) providing a pump within said portable fabric article treating device for moving a benefit composition from said reservoir to said nozzle;

d) attaching said interior housing of said portable fabric article treating device to the interior of said fabric article drying appliance and attaching said exterior housing of said portable fabric article treating device to the exterior of said fabric article drying appliance; and e) spraying said benefit composition through said nozzle into said fabric article drying appliance.

20. The method of claim 19 further comprising subsequent to step e) the step of operating said fabric article drying appliance.

21. The method of claim 19 further comprising applying an electrical charge to said benefit composition prior to step e).

* * * * *